US010549289B2

(12) United States Patent
Romanov et al.

(10) Patent No.: US 10,549,289 B2
(45) Date of Patent: Feb. 4, 2020

(54) FAN ORIFICE DISPENSING CLOSURE

(71) Applicant: Silgan Dispensing Systems Slatersville, LLC, Slatersville, RI (US)

(72) Inventors: Sergey Romanov, Cranston, RI (US); Clifford W. Skillin, Blackstone, MA (US); Patrick J. Brannon, Warwick, RI (US)

(73) Assignee: SILGAN DISPENSING SYSTEMS SLATERSVILLE, LLC, North Smithfield, RI (US)

( * ) Notice: Subject to any disclaimer, the term of this patent is extended or adjusted under 35 U.S.C. 154(b) by 277 days.

(21) Appl. No.: 14/755,177

(22) Filed: Jun. 30, 2015

(65) Prior Publication Data

US 2015/0306607 A1 Oct. 29, 2015

Related U.S. Application Data

(63) Continuation-in-part of application No. 14/466,324, filed on Aug. 22, 2014, now Pat. No. 10,406,536,
(Continued)

(51) Int. Cl.
*B05B 1/04* (2006.01)
*B05B 11/04* (2006.01)
(Continued)

(52) U.S. Cl.
CPC ..... *B05B 1/044* (2013.01); *B05B 11/047* (2013.01); *B65D 25/46* (2013.01); *B65D 47/065* (2013.01);
(Continued)

(58) Field of Classification Search
CPC ..... B05B 1/04; B05B 1/044; B05B 1/046; B05B 1/042; B05B 11/0029;
(Continued)

(56) References Cited

U.S. PATENT DOCUMENTS 2,135,237 A * 11/1938 Lewis ..... B65D 47/2037 222/490
2,755,137 A 7/1956 Hughf
(Continued)

FOREIGN PATENT DOCUMENTS

EP 0405472 A1 1/1991
EP 0439109 A2 11/1991
(Continued)

OTHER PUBLICATIONS

International Search Report for WO2009155460 (PCT/US2009/047857), dated Aug. 6, 2009.
(Continued)

*Primary Examiner* — Darren W Gorman
*Assistant Examiner* — Joseph A Greenlund
(74) *Attorney, Agent, or Firm* — Barlow, Josephs & Holmes, Ltd.

(57) ABSTRACT

A dispensing closure for a squeeze-type container produces a fan-type spray in a low pressure environment. The dispensing closure includes a closure body having an upper deck and a skirt depending from the upper deck. The skirt is configured and arranged to attach to a product container, such as a squeeze-type container. A flow conduit extends from an interior of the closure body and through the upper deck to provide a flow path from an interior of the closure to an exterior of the closure. The flow conduit has an entrance orifice and an exit orifice. The flow conduit and the closure body are integrally formed. The flow conduit includes a tip portion with an exit orifice defining a shape to provide a fan-type spray in a low pressure environment.

13 Claims, 40 Drawing Sheets

Related U.S. Application Data which is a continuation of application No. 13/178,385, filed on Jul. 7, 2011, now Pat. No. 8,814,010, which is a continuation-in-part of application No. 12/487,583, filed on Jun. 18, 2009, now Pat. No. 8,469,241.

(60) Provisional application No. 61/073,616, filed on Jun. 18, 2008.

(51) Int. Cl.

| | |
|---|---|
| ***B65D 47/30*** | (2006.01) |
| ***B65D 47/24*** | (2006.01) |
| ***B65D 47/08*** | (2006.01) |
| ***B65D 47/06*** | (2006.01) |
| ***B05B 11/00*** | (2006.01) |
| *B65D 25/46* | (2006.01) |
| *B65D 47/20* | (2006.01) |

(52) U.S. Cl.
CPC ..... *B65D 47/2006* (2013.01); *B65D 47/305* (2013.01)

(58) Field of Classification Search
CPC . B05B 11/0032; B05B 11/047; B65D 47/305; B65D 47/065; B65D 47/066; B64D 47/306; B64D 47/065; B64D 47/066; B64D 47/2006
USPC ..... 239/592, 597, 601, 508; 222/536, 534, 222/556, 575; 215/389
See application file for complete search history.

(56) References Cited

U.S. PATENT DOCUMENTS 2,759,643 A 8/1956 Dahlin
2,979,238 A * 4/1961 Bramming ..... A47G 21/18 222/484
3,045,880 A * 7/1962 Akers ..... B65D 47/066 222/536
3,094,256 A 6/1963 Ensch
3,111,245 A * 11/1963 Libit ..... B65D 47/305 222/534
3,163,337 A * 12/1964 Wilson ..... B65D 47/305 222/534
3,265,256 A * 8/1966 Chaber ..... B65D 47/305 222/534
RE26,318 E * 12/1967 Wilson ..... B65D 47/305 222/512
3,477,618 A * 11/1969 Hazard ..... B65D 47/305 222/534
3,495,745 A * 2/1970 Akers ..... B65D 47/305 222/534
3,542,256 A * 11/1970 Waterman ..... B65D 47/305 222/484
3,653,546 A * 4/1972 Hazard ..... B65D 47/305 222/83
3,655,099 A * 4/1972 Hazard ..... B65D 47/305 222/153.06
3,774,822 A * 11/1973 Hazard ..... B65D 47/305 222/541.6
3,776,428 A * 12/1973 Hazard ..... B65D 47/305 222/153.09
3,782,577 A * 1/1974 Levey ..... B65D 47/305 215/206
3,786,964 A * 1/1974 Landen ..... B65D 47/305 222/153.14
3,877,598 A * 4/1975 Hazard ..... B65D 47/148 215/224
3,957,181 A * 5/1976 Hazard ..... B65D 47/305 222/534
4,022,352 A 5/1977 Pehr
4,081,108 A * 3/1978 Wilson ..... B65D 47/305 222/153.06
4,081,113 A * 3/1978 Hazard ..... B65D 47/305 222/534
4,109,869 A 8/1978 Brockelsby et al.
4,175,704 A 11/1979 Cohen
4,232,688 A * 11/1980 Day ..... A61C 9/0033 132/327
4,282,991 A * 8/1981 Hazard ..... B65D 47/305 222/531
4,377,247 A 3/1983 Hazard et al.
4,420,100 A 12/1983 Mueller
4,561,570 A * 12/1985 Zulauf ..... B65D 47/2031 222/153.14
4,718,607 A 1/1988 Levine
4,756,451 A * 7/1988 Wilson ..... B65D 47/305 215/203
4,760,956 A 8/1988 Mansfield
4,776,494 A * 10/1988 Holoubek ..... B65D 35/40 222/207
4,860,934 A * 8/1989 Komischke ..... B65D 47/066 222/534
4,903,870 A * 2/1990 La Vange ..... B65D 47/305 220/254.6
4,971,256 A 11/1990 Malcolm
5,005,737 A * 4/1991 Rohr ..... B65D 1/32 137/845
5,040,950 A 8/1991 Dalquist et al.
5,356,044 A * 10/1994 LaVange ..... B65D 47/305 222/153.06
5,392,968 A * 2/1995 Dark ..... B65D 47/066 222/528
5,484,087 A * 1/1996 Negrych ..... B65D 83/0011 116/323
5,606,257 A 2/1997 Krauter et al.
5,639,025 A 6/1997 Bush
5,642,860 A 7/1997 Bush et al.
5,664,732 A 9/1997 Smolen et al.
5,692,682 A 12/1997 Soule
5,868,323 A * 2/1999 Cantor ..... B65D 47/0842 222/556
5,873,478 A * 2/1999 Sullivan ..... A47G 19/2266 215/389
5,878,959 A 3/1999 Smolen et al.
5,890,655 A 4/1999 Collias et al.
5,899,368 A * 5/1999 Joulia ..... B65D 47/2037 222/507
5,927,566 A 7/1999 Mueller
5,967,377 A 10/1999 Glynn
6,116,458 A * 9/2000 Dark ..... A47G 19/2266 220/708
6,176,399 B1 1/2001 Schantz et al.
6,234,363 B1 * 5/2001 Stradella ..... B65D 47/2037 222/148
6,257,457 B1 7/2001 Oechsel
6,330,959 B1 * 12/2001 Dark ..... B65D 41/47 215/250
6,419,101 B1 7/2002 Hessel et al.
6,478,184 B2 11/2002 Berge et al.
6,659,369 B1 12/2003 Foster et al.
6,662,973 B1 * 12/2003 Velliquette ..... B65D 47/42 222/207
6,698,605 B2 3/2004 Clodfelter et al.
6,877,681 B2 4/2005 Hartle et al.
6,991,139 B2 1/2006 Garcia et al.
7,059,490 B2 * 6/2006 Son ..... B65D 25/465 220/254.3
7,124,962 B1 10/2006 Fryan et al.
7,165,549 B2 * 1/2007 Philipps ..... A61H 35/04 128/207.16
7,533,783 B2 * 5/2009 Choi ..... A47G 19/2266 220/714
7,594,595 B2 * 9/2009 Gueret ..... A45D 33/006 222/1
7,762,438 B2 7/2010 Skillin
7,828,166 B1 11/2010 Sprick

(56) References Cited

U.S. PATENT DOCUMENTS 8,469,226 B2 * 6/2013 Davies ..... A47G 19/2266 220/707
8,469,241 B2 6/2013 Romanov et al.
8,672,174 B1 * 3/2014 McMullin ..... A47G 21/18 215/229
8,827,099 B2 * 9/2014 Joy ..... A47G 19/2266 215/388
9,586,732 B2 * 3/2017 Son ..... B65D 25/465
9,884,706 B1 * 2/2018 Skillin ..... B65D 47/0838
2002/0047023 A1 * 4/2002 Haglund ..... B65D 47/26 222/107
2002/0170873 A1 11/2002 Clodfelter et al.
2004/0079766 A1 * 4/2004 Kokubo ..... B65D 47/0838 222/212
2005/0211271 A1 9/2005 Brumlik
2005/0279776 A1 12/2005 Decottignies et al.
2006/0038039 A1 2/2006 Carta
2006/0175361 A1 * 8/2006 Heukamp ..... B65D 41/04 222/534
2006/0273195 A1 12/2006 Junkel
2007/0029352 A1 * 2/2007 Norris ..... B65D 47/0833 222/494
2007/0295763 A1 12/2007 Brunner et al.
2007/0295764 A1 12/2007 Socier
2008/0035681 A1 2/2008 Skillin
2008/0272122 A1 * 11/2008 Son ..... B65D 5/727 220/278
2009/0065464 A1 * 3/2009 Cuocolo, Jr. ..... B65D 47/0847 215/228
2009/0084814 A1 * 4/2009 Wisniewski ..... B65D 47/0838 222/83
2009/0314856 A1 12/2009 Romanov et al.
2010/0032454 A1 * 2/2010 Moribata ..... A45D 40/0075 222/494
2010/0065588 A1 3/2010 Brannon et al.
2012/0000944 A1 * 1/2012 Romanov ..... B05B 1/042 222/556
2013/0026188 A1 * 1/2013 Lenz ..... B65D 47/065 222/153.14
2015/0265079 A1 * 9/2015 Kamping ..... A47G 19/2272 220/203.12
2015/0306607 A1 * 10/2015 Romanov ..... B65D 47/305 222/153.04

FOREIGN PATENT DOCUMENTS

EP 0905052 A1 3/1999
EP 0911616 A1 4/1999
EP 2204333 A1 7/2010
EP 2427388 A1 3/2012
WO WO9702896 1/1997
WO WO2002098756 A2 3/2003
WO WO2004043820 A1 5/2004

OTHER PUBLICATIONS

International Search Report for WO2013012558 (PCT/US2012/045440), dated Oct. 5, 2012.
In RE: Application 09767769.4-2425 PCT/US2009/047857 in the name of Polytop Corporation extended European search report dated Apr. 12, 2012.
In RE: Application 12815592.6-1760 PCT/US2012/045440 in the name of MWV Slatersville LLC extended European search report dated Feb. 19, 2015.
In RE: Application 12182680.4 extended European search report dated Nov. 12, 2012.

* cited by examiner

FAN ORIFICE DISPENSING CLOSURE

CROSS REFERENCE TO RELATED APPLICATIONS

This application is a continuation-in-part of U.S. application Ser. No. 14/466,324, filed Aug. 22, 2014, which is a continuation of U.S. application Ser. No. 13/178,385, filed Jul. 7, 2011 (now U.S. Pat. No. 8,814,010, granted Aug. 26, 2014), which is a continuation-in-part of U.S. application Ser. No. 12/487,583 filed Jun. 18, 2009 (now U.S. Pat. No. 8,469,241, granted Jun. 25, 2013), which is a non-provisional application of, and claims the benefit to, U.S. Provisional Patent Application No. 61/073,616 filed Jun. 18, 2008, the entire contents all of which are incorporated herein by reference.

BACKGROUND OF THE INVENTION

The invention relates to container closures, and more particularly to squeeze-type container dispensing closures. This invention relates to a dispensing closure for dispensing liquid. More specifically, it relates to a dispensing closure defining an orifice in the closure to produce a fan-type discharge or spray in a low-pressure environment.

The prior art discloses numerous patents related to high pressure environments for producing various sprays. U.S. Pat. No. 2,755,137 discloses a liquid spray jet and has for its object the provision of a jet. The spray jet includes a jet member having a parallel sided slot. U.S. Pat. No. 4,175,704 discloses a non-aerosol type spray dispenser. The end of a tubular member mounts a spray nozzle built into a parabolic section which extends outwardly from the end of the actuator. U.S. Pat. No. 4,718,607 generally shows a spray orifice adapted for discharging a mixture of atomized liquid entrained within a gas stream for coating a surface with the liquid. U.S. Pat. No. 4,760,956 shows a spray gun that includes a mixing apparatus and an atomizer including a liquid nozzle.

Also, the prior art discloses the use of additional non-squeeze-type dispensing closures to produce various sprays in a high pressure environment. U.S. Pat. No. 4,971,256 shows a sprinkler having a nozzle head abutting the end wall and defining a vertical slot extending radially therethrough. U.S. Pat. No. 5,642,860 shows a slotted spray nozzle. U.S. Pat. No. 5,890,655 discloses a fan spray nozzle having elastomeric dome-shaped tips with a flow conduit outwardly extending from the upper deck. The '655 patent discloses the spray nozzle being made of an elastomeric material having a flexural modulus from about 1,000 psi to about 25,000 psi.

Based upon the prior art cited above, there remains a need for a dispensing closure having a dispensing orifice which allows for liquid discharges in the form of a fan-type spray in a low pressure environment produced by a squeeze-type container.

BRIEF SUMMARY OF THE INVENTION

The invention preserves the advantages of prior dispensing closures for squeeze-type containers. In addition, it provides new advantages not found in currently available dispensing closures for squeeze-type containers and overcomes many disadvantages of such currently available dispensing closures for squeeze-type containers.

The dispensing closure for a squeeze-type container produces a fan-type spray in a low pressure environment. The dispensing closure includes a closure body having an upper deck and a skirt depending from the upper deck. The skirt is configured and arranged to attach to a squeeze-type product container. A flow conduit extends from an interior of the closure body and through the upper deck to provide a flow path from an interior of the closure to an exterior of the closure. The flow conduit has an entrance orifice and an exit orifice. The flow conduit has an inner wall extending between the entrance orifice and the exit orifice.

The flow conduit is configured to produce a fan-type spray in a low pressure environment. A low pressure environment may be produced by a squeeze-type product container upon a force being applied to the product container by a user. In one embodiment, the fan-type spray is provided at less than 5 psi. Alternatively, the fan-type spray may be produced between 0.5 psi and 3 psi which is typically the result of a squeeze produced by an average person.

The flow conduit includes a tip portion for producing a fan-type spray. The tip portion including a raised non-planar surface having an interior volume to collect liquid before the liquid exits through the exit orifice in a low pressure environment. The tip portion defines a shape of the exit orifice which produces the fan-type spray. For example, the shape of the exit orifice may be rectangular, bowtie, half bowtie, oval, keyhole, dumbbell, curved rectangular, "J", "T", inverted "T", inverted "J", and other non-circular shapes. Also, it should be noted that to produce a continuous fan-type spray with desired dimension, the exit orifice may also define a uniform width, with regard to the rectangular shaped orifice, and the tip portion may have a relatively uniform thickness of material.

In one embodiment, the flow conduit, the closure body, and the tip portion are integrally formed to facilitate the fan-type spray in a low pressure environment. The flow conduit includes a first body portion of the flow conduit extending from the upper deck to the tip portion in a gradually decreasing diameter. The tip portion has a height less than the first body portion of the flow conduit. Note, a peripheral wall extends upwardly from the upper deck to surround the first body portion of the flow conduit to capture excess fluids.

In one embodiment including a closure lid, the dispensing closure includes a multiple sealing mechanisms to prevent liquid from exiting through the exit orifice. In one embodiment, the dispensing closure includes a closure lid, a hinge mechanism for connecting the lid to the body and a latching mechanism for securing the lid to the body. In a first sealing mechanism for a dispensing closure having a closure lid, a sealing wedge is positioned on an interior surface of the lid for sealing engagement through the exit orifice of the flow conduit when the lid is in a closed position to prevent the exit of liquid through the exit orifice.

In a second sealing mechanism for a dispensing closure having a closure lid, a sealing member portion of the flow conduit is positioned at upper portion of the flow conduit for engaging an interior of the closure lid when the lid is in a closed position. The interior of the closure lid includes a seal bead to frictionally engage the sealing member portion to prevent the flow of liquid out of the exit orifice. Alternatively, the sealing member portion includes a seal bead to frictionally engage the interior of the closure lid.

In a third sealing mechanism for a dispensing closure having a closure lid, the closure lid includes a mating surface corresponding to an exterior surface of the tip portion. When the lid is in a closed position, the mating surface seals against the tip portion to prevent the flow of liquid through said exit orifice of the flow conduit.

In another embodiment having an insert member, the dispensing closure includes multiple sealing mechanisms to prevent liquid from exiting through the exit orifice. The dispensing closure includes an insert member positioned within the exit aperture of the product container. The insert member includes an insert base for seating within the exit aperture of the product container. The insert member also includes a sealing tube portion extending upwardly from said insert base to occupy an interior volume of said flow conduit.

In a first sealing mechanism for a dispensing closure having an insert member, the sealing tube portion includes a mating surface corresponding to an interior surface of the tip portion to prevent flow of liquid through the exit orifice when the closure body is rotated into a closed position to contact the sealing tube portion.

In a second sealing mechanism for a dispensing closure having an insert member, a sealing member portion of the sealing tube portion is positioned at upper portion of the insert member. The sealing member portion engages an interior of the flow conduit when the closure is rotated into in a closed position to contact the sealing tube portion. The interior of the flow conduit includes a seal bead to frictionally engage the sealing member portion to prevent the flow of liquid out of the exit orifice. Alternatively, the sealing member portion includes the seal bead to frictionally engage the interior of the flow conduit.

In another embodiment, the dispensing closure may also include two pairs of opposing stopping tabs on the inner surface of the outer wall, which cooperate with a single pair of opposed stopping lugs on the container finish. A first, opposed pair of stopping tabs function as child resistant latches to resist movement of the dispensing closure from the closed position to the open position. In operation, the dispensing closure must be squeezed at opposing locations (identified with thumb pads) on the dispensing closure to deform the dispensing closure and move the CR tabs outwardly to overcome the stop lugs. Once freed from the stop lugs, the dispensing closure can then rotate 90 degrees where the second set of stopping tabs engages with the stop lugs to prevent further rotation. This second set of stopping tabs prevents complete removal of the dispensing closure from the container finish.

In another embodiment, a dispensing closure for a squeeze-type container may include a closure body including an upper deck and a skirt depending downwardly from the upper deck, the skirt defining a lower interior opening configured and arranged to attach to a neck of the container, a spout pivotally attached to the closure body and movable between a closed position and an open position, the spout including a flow conduit from an interior of the closure to an exterior of the closure, and a dispensing tip portion, an entrance orifice and an exit orifice at the dispensing tip portion, the spout being movable relative to said closure body between the closed position wherein the dispensing tip portion is at least partly recessed into the closure body and the entrance orifice is not in communication with the lower interior opening, and an open position wherein said dispensing tip portion is pivoted upward relative to the closure body and the entrance orifice is in communication with the lower interior opening; the exit orifice being configured and arranged to produce a fan-type spray in a low-pressure environment when the squeeze-type container is inverted and squeezed.

In operation, the dispensing closure of the present invention provides a fan-type spray in a low pressure environment. The low pressure environment may be less than 5 psi. In one embodiment, the dispensing closure is attached to a squeeze-type product container. When the squeeze-type product container has a force applied by a user, the liquid within the container moves through the flow conduit, up through the tip portion, and discharges through the shaped exit orifice to produce a fan-type spray at less than 5 psi.

It is therefore an object of the present invention to provide a fan-type spray in a low pressure environment.

It is another object of the present invention to provide a sealing mechanism to prevent the flow of liquid through the exit orifice.

Another object of the present invention is to provide a one-piece or two-piece dispensing closure.

It is also another object of the present invention to provide a latching mechanism for securing the lid to the closure body.

A further object of the present invention is to provide a child-resistant latching mechanism.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENTS

In accordance with the present invention, a dispensing closure for squeeze-type containers is disclosed. This invention relates to a dispensing closure for dispensing liquid. More specifically, it relates to a dispensing closure defining an exit orifice in the closure to produce a fan-type discharge or spray in a low-pressure environment.

Figure 1:
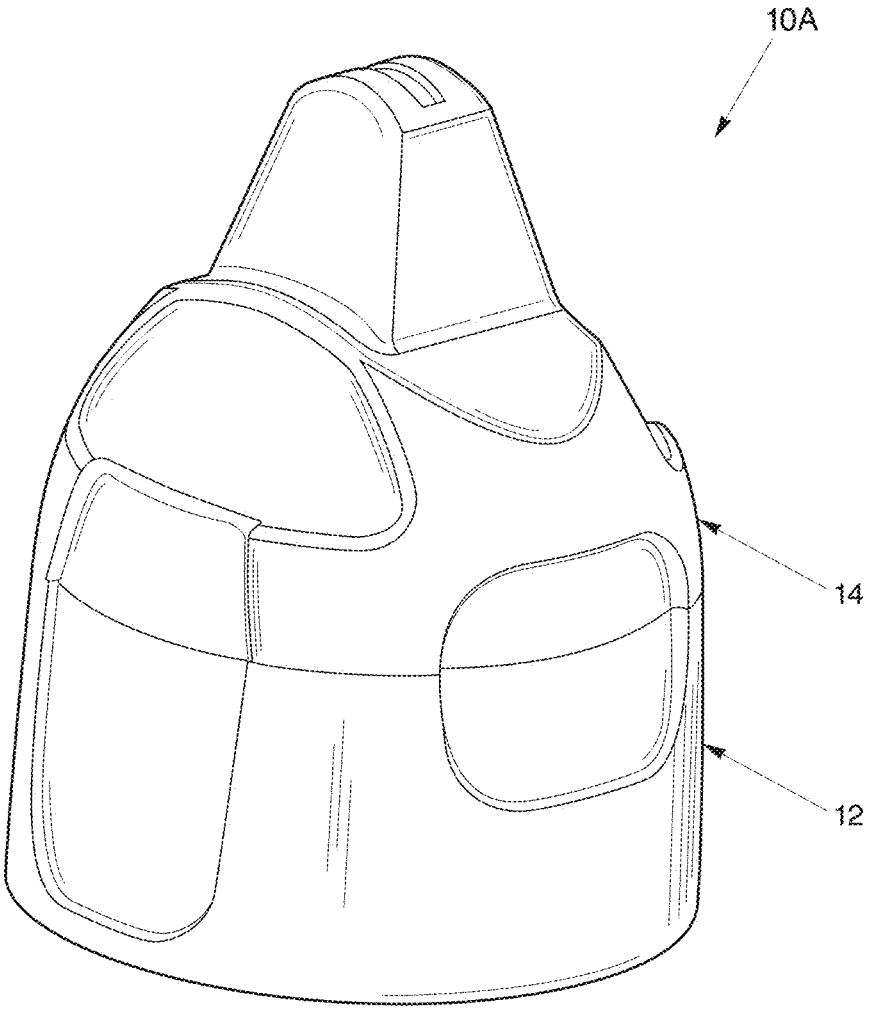
FIG. 1 is a perspective view of a one-piece dispensing closure with a closure lid in an closed position.
Figure 2:
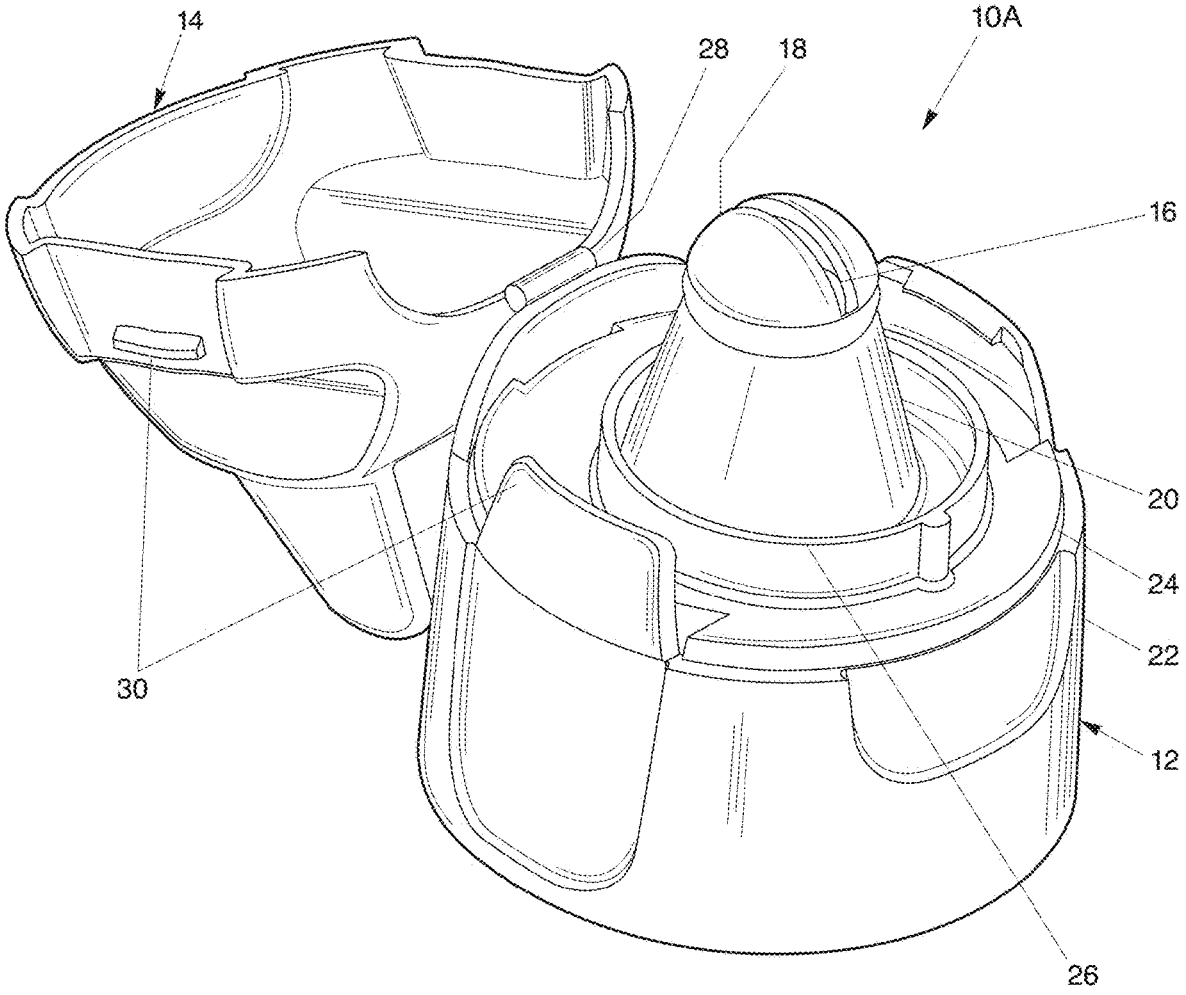
FIG. 2 is a perspective view of the dispensing closure of FIG. 1 in an open position.
Figure 3:
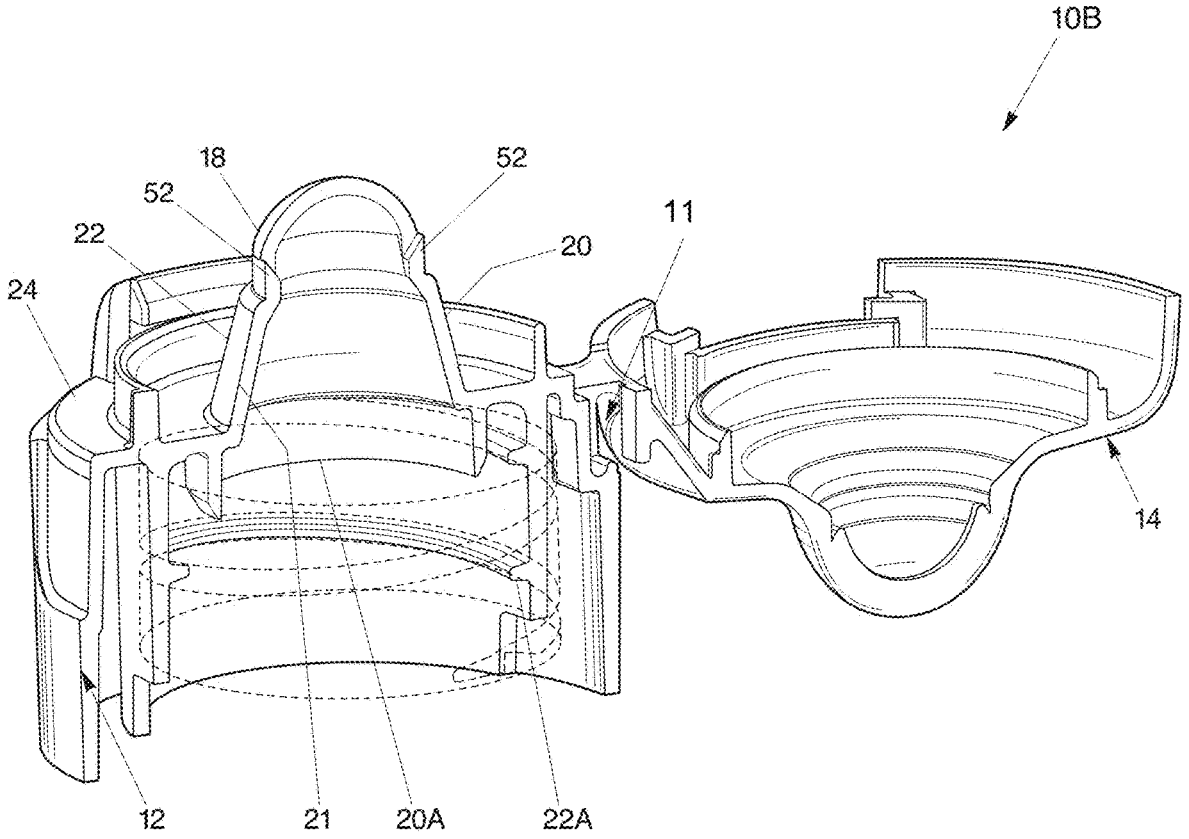
FIG. 3 is a cross-sectional view of a dispensing closure with a closure lid in an open position showing in dotted lines the outline of a neck of a product container.

As shown generally in FIGS. 1-44, the present invention is generally directed to a novel dispensing closure for squeeze-type containers. Most importantly, as shown in FIGS. 1-3, the dispensing closure 10 has an exit orifice 16 defined in a tip portion 18 of the flow conduit 20. The tip portion 18 includes a raised non-planar surface which allows for a collection of liquid before discharging liquid in a fan-type spray through the exit orifice 16 in a low pressure environment. As shown in FIG. 2, it should be noted that a raised spherical surface may be one type of non-planar surface used in the present invention but it is not limited to a raised spherical surface. Also, it should be further noted that the exit orifice 16 may have a shape other than rectangular depending upon the viscosity of the liquid and desired dimension of the fan-type spray.

A low pressure environment may be produced by a squeeze-type product container 900 (FIG. 21) upon a force being applied to the product container 900 by a user. In one embodiment, the fan-type spray is provided at less than 5 psi. Alternatively, the fan-type spray may be produced between 0.5 psi and 3 psi which is typically the result of an average squeeze produced by a person of average strength.

Referring to FIG. 2, the dispensing closure 10 for a squeeze-type container produces a fan-type spray in a low pressure environment. Generally, each of the embodiments includes a closure body 12 having an upper deck 24 and a skirt 22 depending from the upper deck 24 where the skirt 22 is configured and arranged to attach to a product container 900, such as squeeze-type product container 900 or inverted-type container (not shown). Referring to FIG. 3, the skirt 22 includes internal threads 22A for threaded mounting on an open end or neck of a product container (illustrated in dotted lines). However, it is to be understood that other skirt mounting arrangements are also contemplated within the scope of the invention, and the invention should not be limited to the inwardly threaded skirt as the singular means for mounting. Furthermore, the skirt 22 may be a singular or double walled skirt.

A flow conduit 20 extends from an interior of the closure body 12 and through the upper deck 24 to provide a flow path from an interior of the closure 10 to an exterior of the closure 10. The flow conduit 20 has an entrance orifice 20A within the interior of the closure body 12 and an exit orifice 16 outside the exterior of the closure body 12. In one embodiment, the flow conduit 20 is raised in an elongated manner outside the exterior surface of the closure body 12. The flow conduit 20 has an inner wall 21 extending between the entrance orifice 20A and the exit orifice 16. The inner wall 21 is gradually inclined to funnel liquid from an interior of the closure body 12 to the tip portion 18. Note, a peripheral wall 26 extends upwardly from the upper deck 24 to surround a first body portion of the flow conduit 20 to capture excess liquids.

The flow conduit 20 includes the tip portion 18 for facilitating the production of a fan-type spray through the exit orifice 16. The tip portion 18 includes the raised non-planar surface having an interior volume to collect liquid before the liquid exits through the exit orifice 16 under low pressure. The collection of liquid within an interior volume of the raised non-planar surface provides a continuous and even flow of liquid as it exits through the exit orifice 16.

The tip portion 18 defines a shape of the exit orifice 16 which facilitates the production of the fan-type spray. Referring back to FIG. 2, the dispensing orifice 16 is defined along a diameter of a non-planar surface of the flow conduit 20 and the orifice 16 has a substantially rectangular shape. The rectangular exit orifice 16 has a uniform width to provide a uniform thickness and width of the fan-type spray when it exits through the exit orifice 16. Also, it should be noted that to produce a continuous fan-type spray, the exit orifice 16 may also define a uniform width, especially for the rectangular shape, and the tip portion 18 may have a relatively uniform thickness of material.

It should be noted that the rectangular exit orifice 16 and tip portion 18 having the non-planar surface, disclosed in FIGS. 1-3, are an example and that it is contemplated that other dimensions of the width and depth of the tip portion 18 and a radius of the exit orifice 16 may be adjusted to accommodate varying viscosity of the liquid, desired dimensions of the fan-type spray, and intended purpose of the liquid.

The dispensing closure 10 can provide a fan-type discharge using multiple configurations of the dispensing orifice 16. Other shapes of the exit orifice 16 that may be used are, for example, a bowtie shape (FIG. 14), curved rectangular shape (FIG. 15), dumbbell shape (FIG. 16), half bowtie shape (FIG. 17), keyhole shape (FIG. 18), oval shape (FIG. 19), "J" shape, "T" shape, inverted "T" shape, inverted "J" shape, and other non-circular shapes.

The bowtie shape (FIG. 14) of the dispensing or exit orifice 16 provides a lighter stream of liquid from the middle of the dispensing orifice 16 and heavier stream of liquid at its ends. This may be particularly desirable for purposes of discharging a toilet bowl cleaner inside an interior of a bowl where more liquid may be desirable in an upper lip area and towards the center of the bowl. In another embodiment, the dispensing orifice may be designed in the shape of a "T", "J", inverted "J", and inverted "T". These different configurations provide a lighter stream of liquid from the middle of the dispensing orifice with a heavier stream at a single end.

In another embodiment, the dispensing orifice 16 may also have a non-uniform width along the tip portion 18 of the flow conduit 20. For example, the "fan" orifice 16 may have an increased or decreased width of the dispensing orifice 16 depending upon the viscosity of the product and desired angular flow of the liquid.

Also, the dispensing orifice 16 may extend less than the entire radius or diameter of the non-planar surface area of the tip portion 18. The dispensing orifice 16 may be set off its normal orientation, by degrees, in order to provide a better or optimal angle for streaming liquid into a toilet bowl or other desirable environment. It should also be noted that the fan-type spray from the present invention may be adjusted by using different shapes, sizes, and/or configurations in accordance with those dispensing characteristics desired.

In one embodiment, the flow conduit 20, the closure body 12, and the tip portion 18 are integrally formed to facilitate the fan-type spray in a low pressure environment. The flow conduit 20 includes a first body portion of the flow conduit 20 extending from the upper deck 24 to the tip portion 18 in a gradually decreasing diameter. The tip portion 18 has a height less than the first body portion of the flow conduit 20 to funnel liquid from an interior of the closure body 12 to the tip portion 18.

Now referring generally to FIGS. 1-3, in a one-piece dispensing closure 10 including a closure lid 14, the dispensing closure 10 includes multiple sealing mechanisms to prevent liquid from exiting through the exit orifice 16. In one embodiment, the dispensing closure 10 includes a closure lid 14, a hinge mechanism 28 for connecting the lid 14 to the body 12, and a latching mechanism 30 for securing the lid 14 to the body 12.

Figure 6:
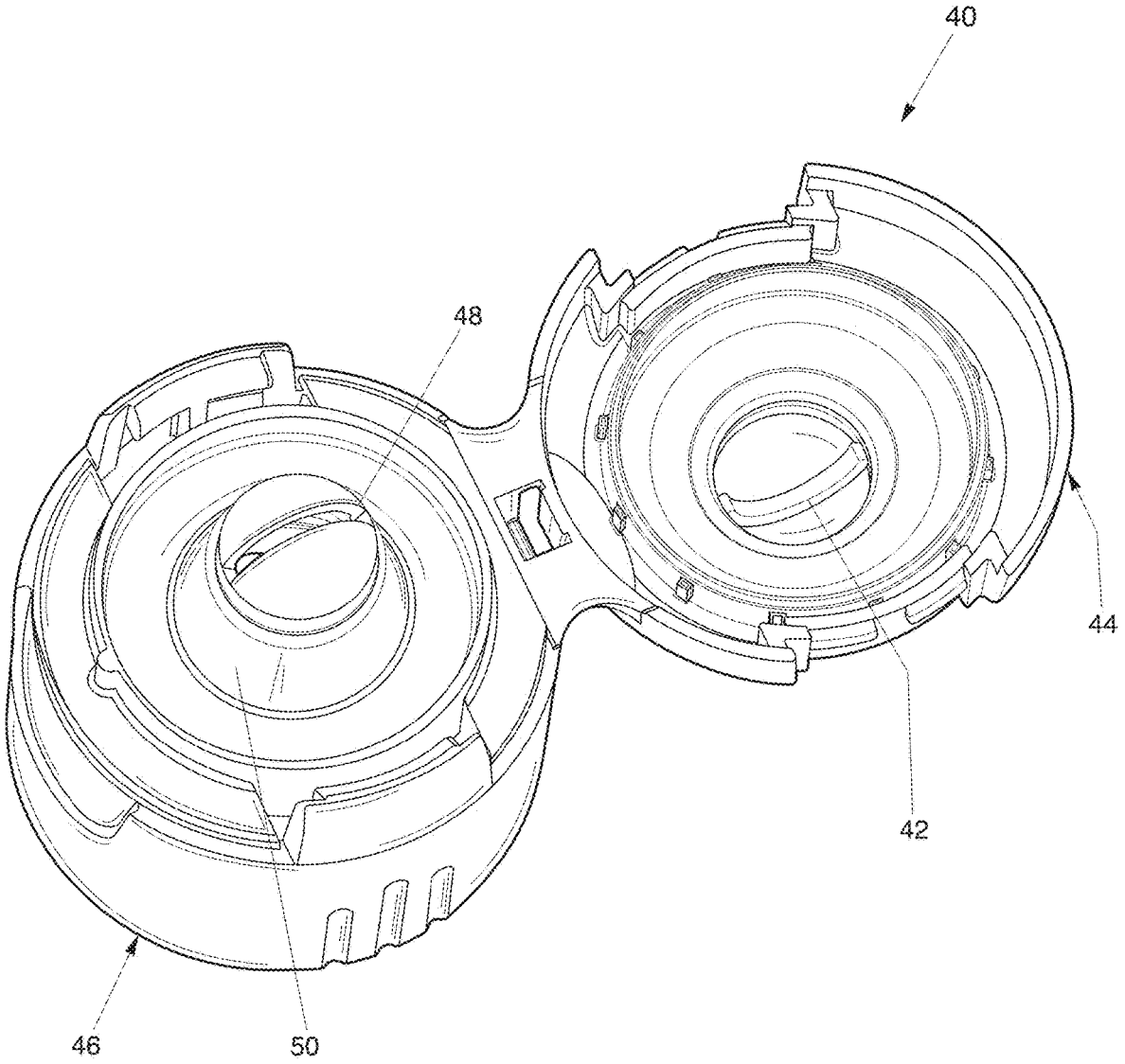
FIG. 6 is a top view of a dispensing closure with a closure lid having a sealing wedge in an open position.
Figure 7:
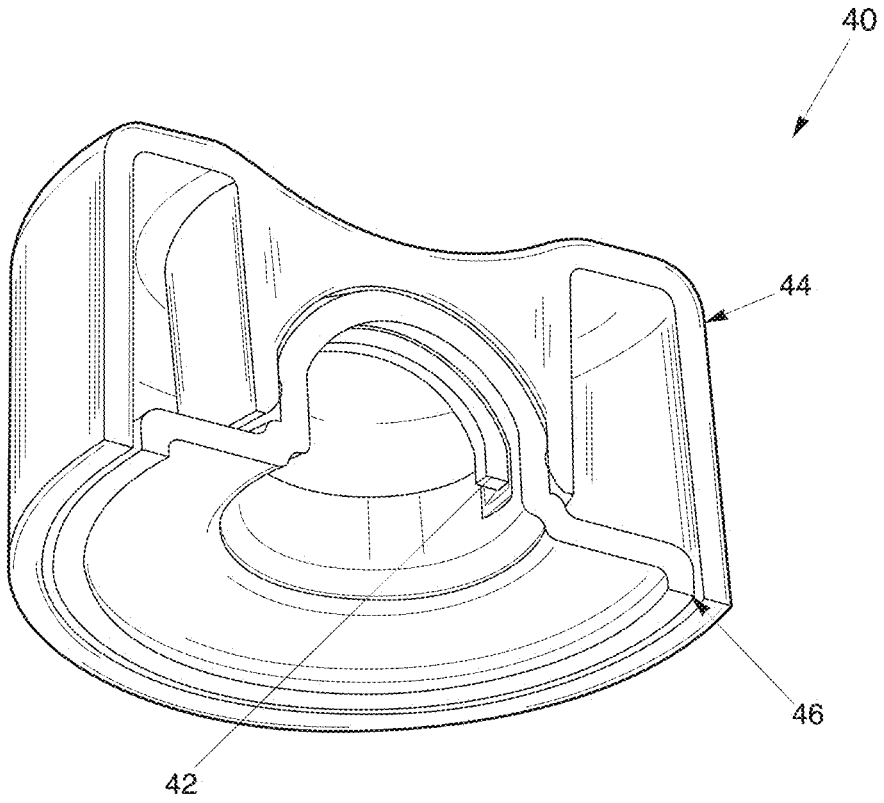
FIG. 7 is an elevated cross-sectional view of a dispensing closure with a closure lid having a sealing wedge in a closed position.
Figure 8:
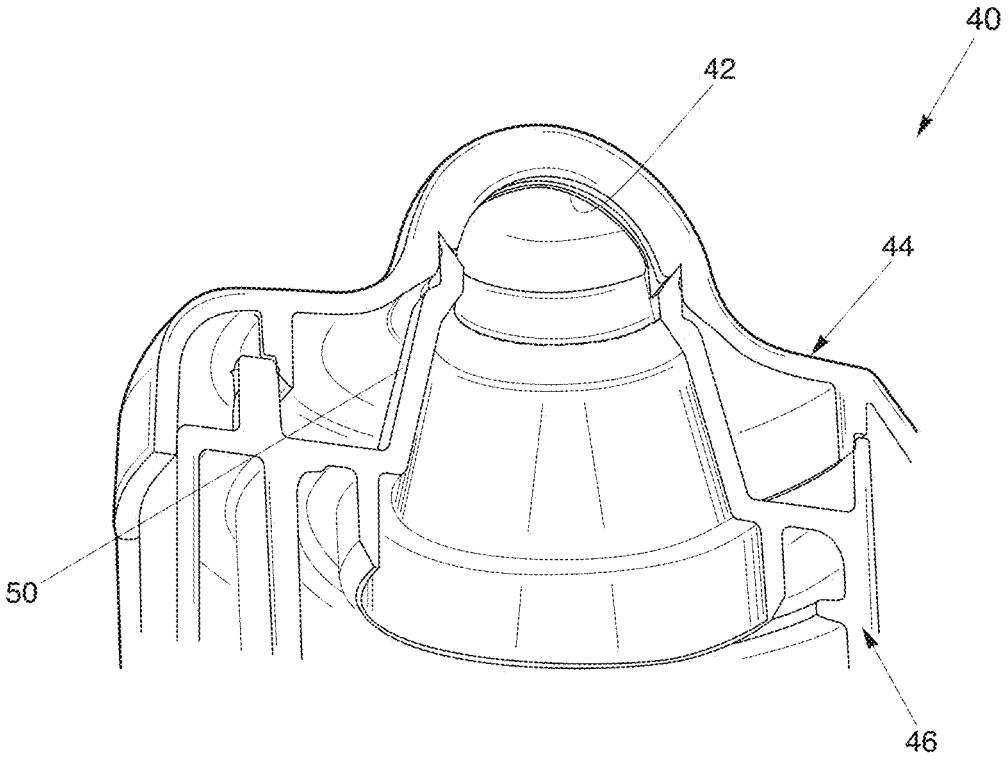
FIG. 8 is a cross-sectional view of the dispensing closure of FIG. 6 having a closure lid having a sealing wedge in a closed position.

Referring to FIGS. 6-8, in a first sealing mechanism for a dispensing closure 40 having a closure lid 44, a sealing wedge 42 is positioned on an interior surface of the lid 44 for sealing engagement through the exit orifice 48 of the flow conduit 50 when the lid 44 is in a closed position to prevent the exit of liquid through the exit orifice 48.

Figure 4:
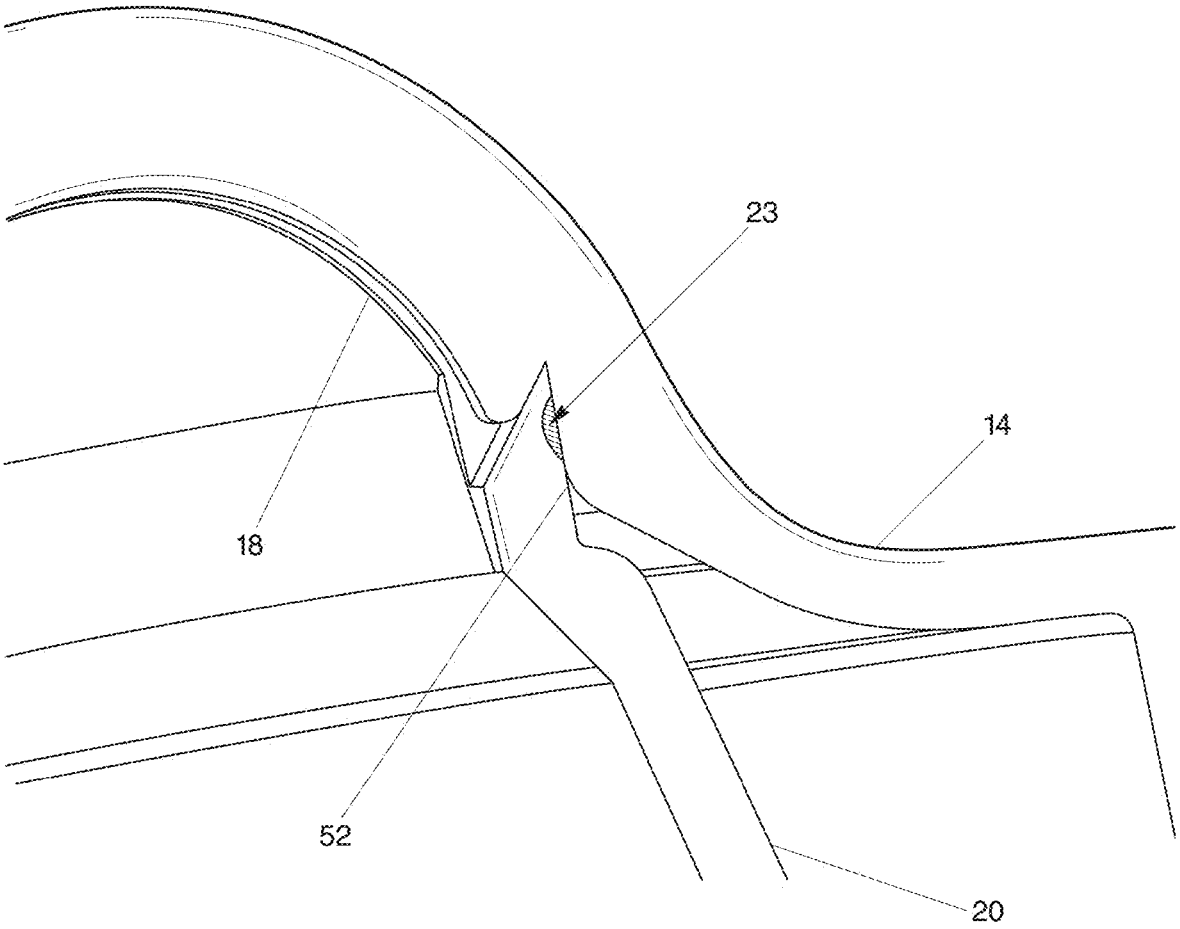
FIG. 4 is an elevated cross-sectional view of the dispensing closure of FIG. 3 with closure lid in a closed position.

Referring to FIGS. 3-4, in a second sealing mechanism for a dispensing closure 10B having a closure lid 14, a sealing member portion 52 of the flow conduit 20 is positioned at an upper portion of the flow conduit 20 for engaging an interior of the closure lid 14 when the lid 14 is in a closed position. The interior of the closure lid 14 includes a seal bead 23 to frictionally engage the sealing member portion 52 to prevent the flow of liquid out of the exit orifice 16. Alternatively, the sealing member portion 52 includes a seal bead to frictionally engage the interior of the closure lid 14.

In a third sealing mechanism for a dispensing closure 10B having a closure lid 14, the closure lid 14 includes a mating surface corresponding to an exterior non-planar surface of the tip portion 18. When the lid 14 is in a closed position, the mating surface seals against the tip portion 18 to prevent the flow of liquid through the exit orifice 16 of the flow conduit 20.

In a fourth sealing mechanism for a dispensing closure 60 having a closure lid 62, the closure lid 62 includes an inner circular wall 66 depending from a central region. Preferably, the inner circular wall 66 has a diameter to allow for a friction fit with the sealing member portion 68 of the flow conduit 70. When the closure lid 62 is in a closed position, the inner circular wall 66 snaps over the exit orifice 72 to prevent the exit of liquid therethrough.

Now referring generally to FIGS. 9-13, in a two-piece dispensing closure 80 having an insert member 84 and a closure body 82, the dispensing closure 80 includes multiple sealing mechanisms to prevent liquid from exiting through the exit orifice 86. The dispensing closure 80 includes an insert member 84 positioned within the open end of the product container 900. The insert member 84 includes an insert base 88 for seating within the open end of the product container 900. The insert member 84 also includes a sealing tube portion 90 extending upwardly from said insert base 88 to occupy an interior volume of the flow conduit 92.

Figure 9:
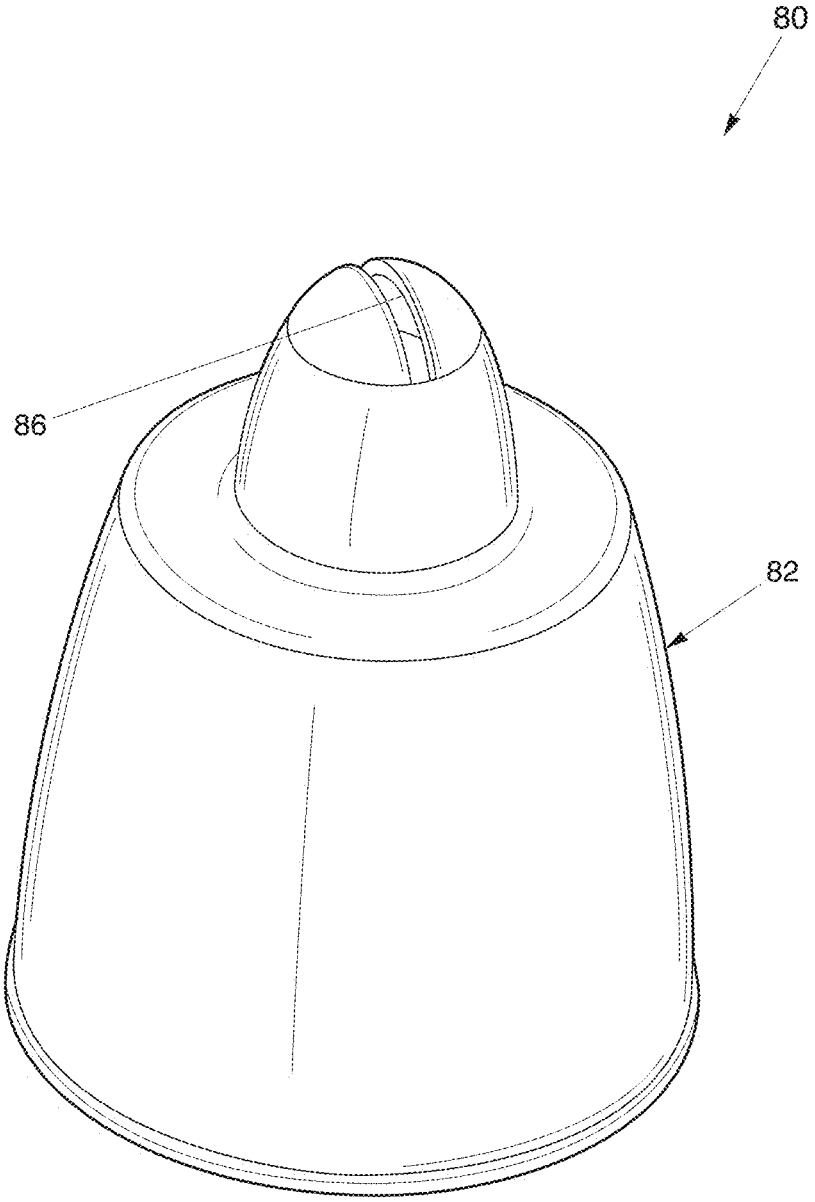
FIG. 9 is a perspective view of a two-piece dispensing closure with an insert member.
Figure 10:
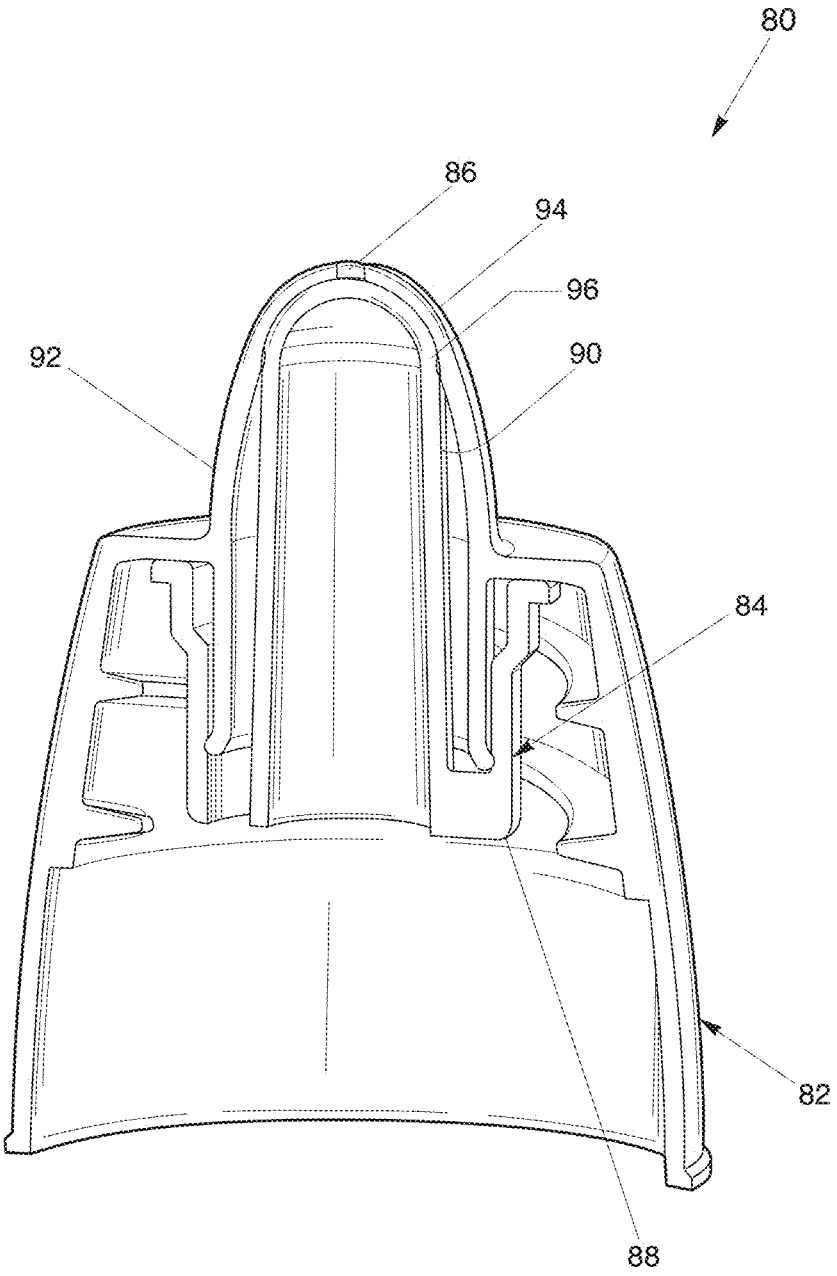
FIG. 10 is a cross-sectional view of the dispensing closure of FIG. 9 in a closed position.

Referring to FIG. 9-10, in a first sealing mechanism for a dispensing closure 80 having an insert member 84, the sealing tube portion 90 includes a mating surface corresponding to an interior surface of the tip portion 94. When the closure body 82 is rotated into a closed position to contact the sealing tube portion 90 with the interior surface of the tip portion 94, the liquid is prevented from discharging through the exit orifice 86.

Figure 11:
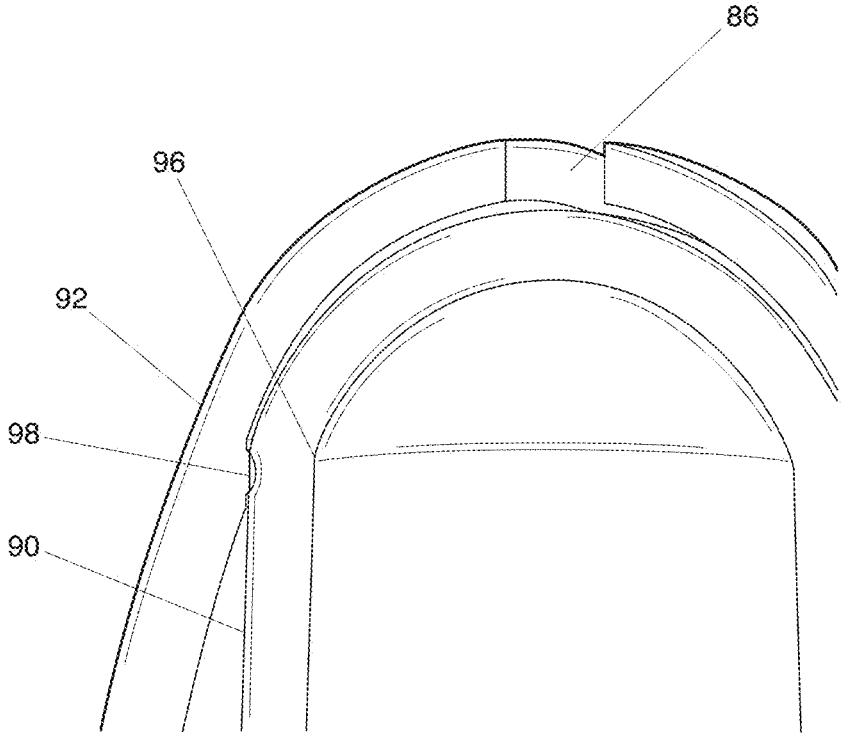
FIG. 11 is an elevated cross-sectional view of the dispensing closure of FIG. 9 in a closed position.
Figure 12:
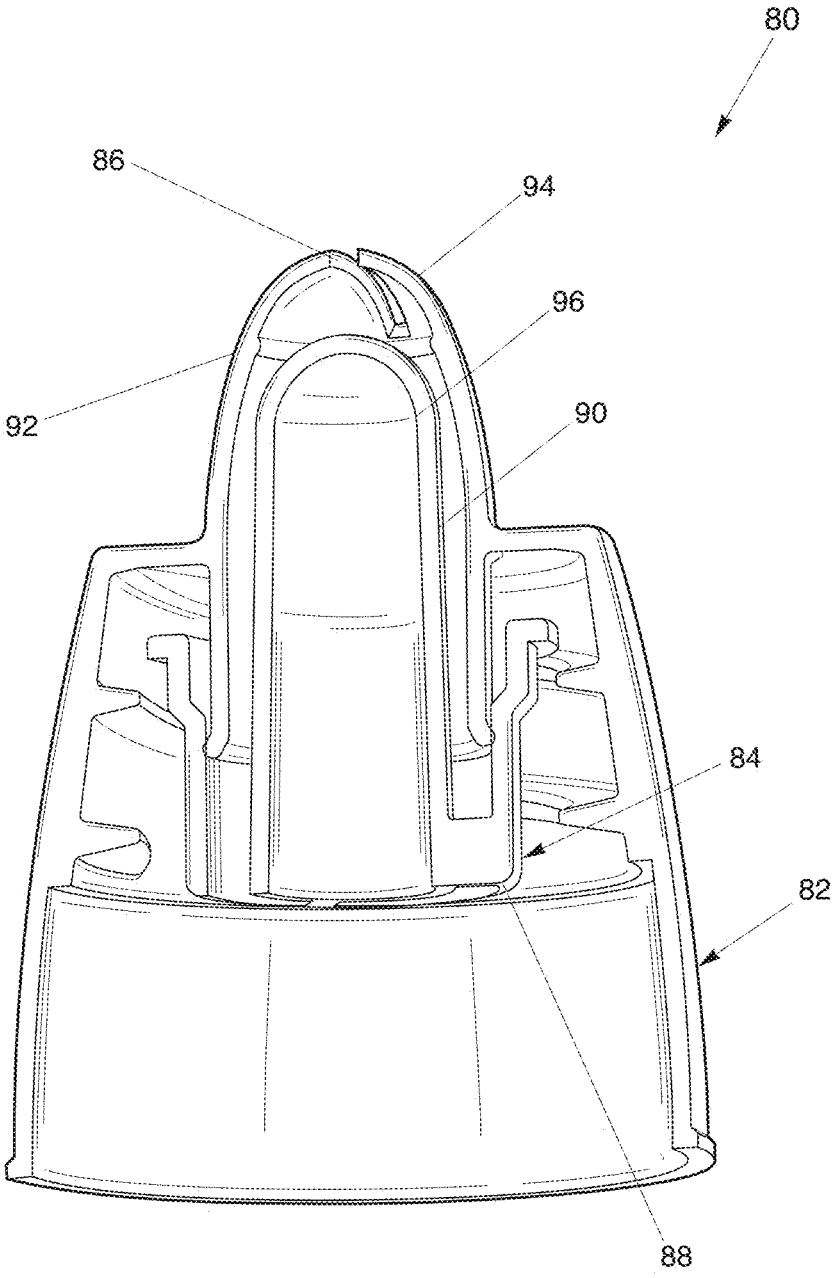
FIG. 12 is a cross-sectional view of the dispensing closure of FIG. 9 in an open position.
Figure 13:
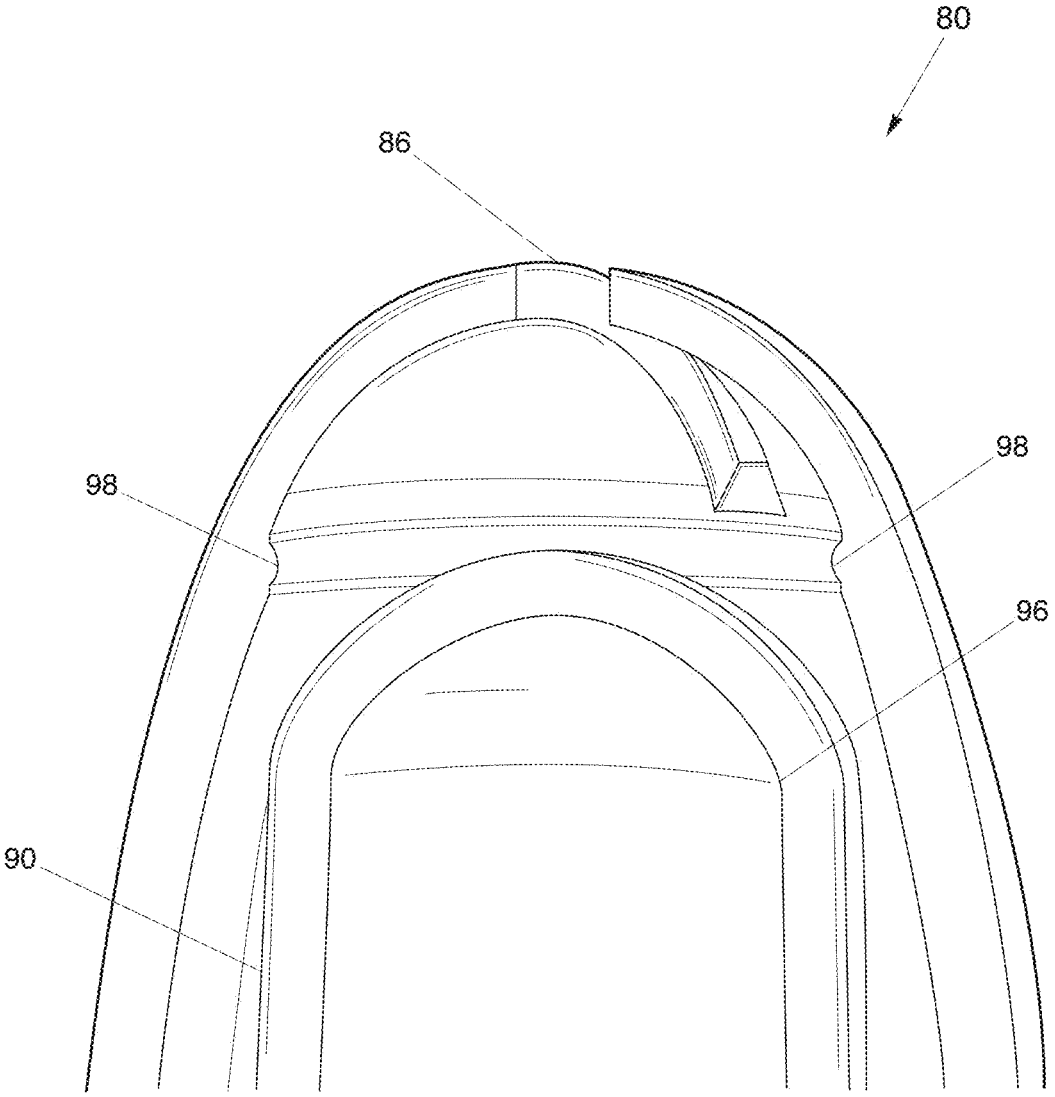
FIG. 13 is an elevated cross-sectional view of the dispensing closure of FIG. 9 in an open position.
Figure 14:
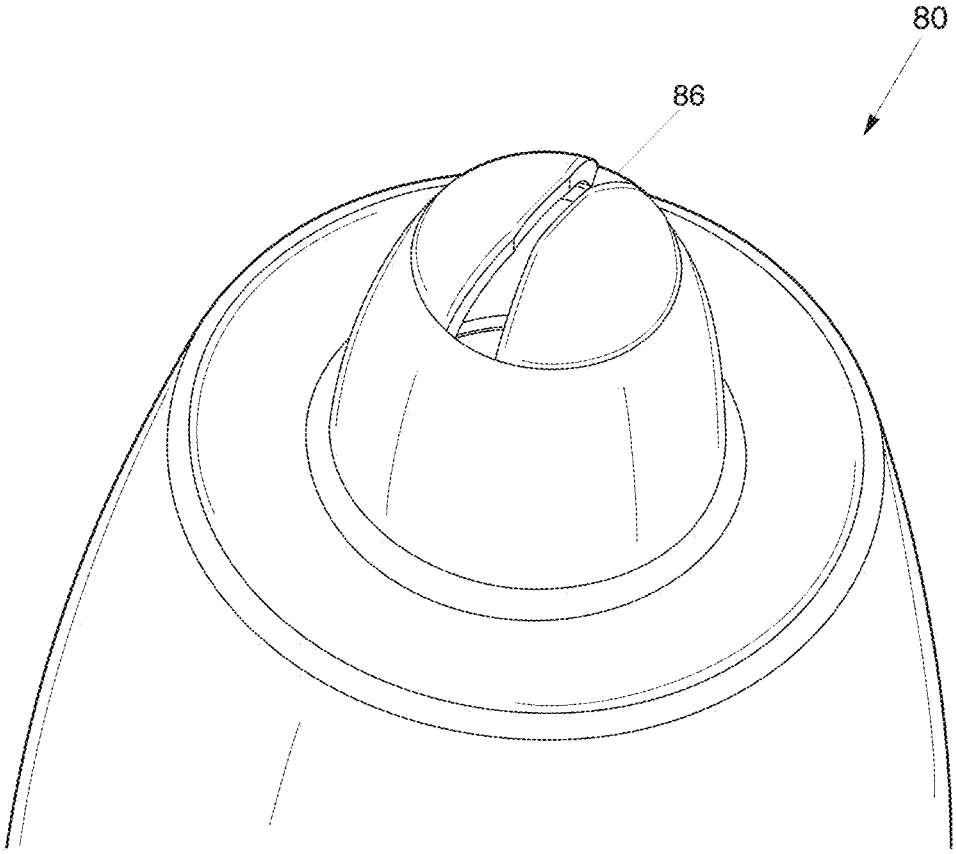
FIG. 14 is a top view of the dispensing closure of FIG. 9 including an exit orifice having a bowtie shape.
Figure 15:
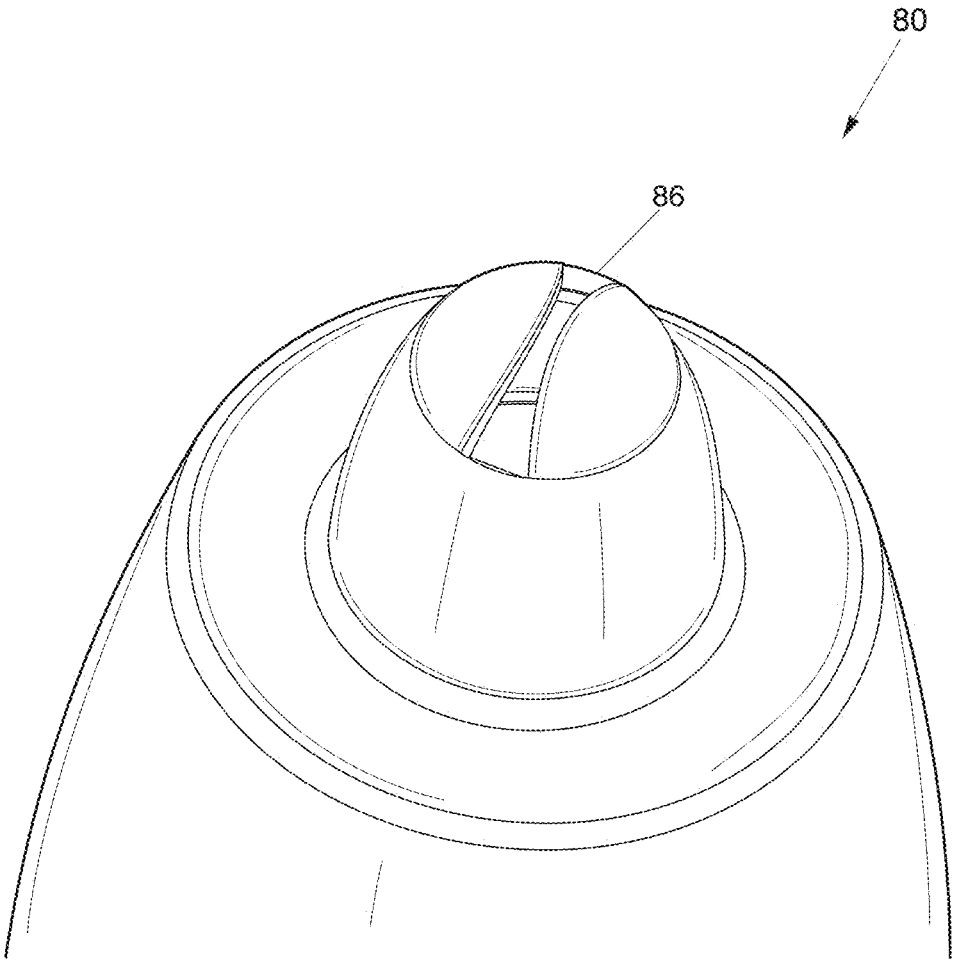
FIG. 15 is a top view of the dispensing closure of FIG. 9 including an exit orifice having a curved rectangular shape.
Figure 16:
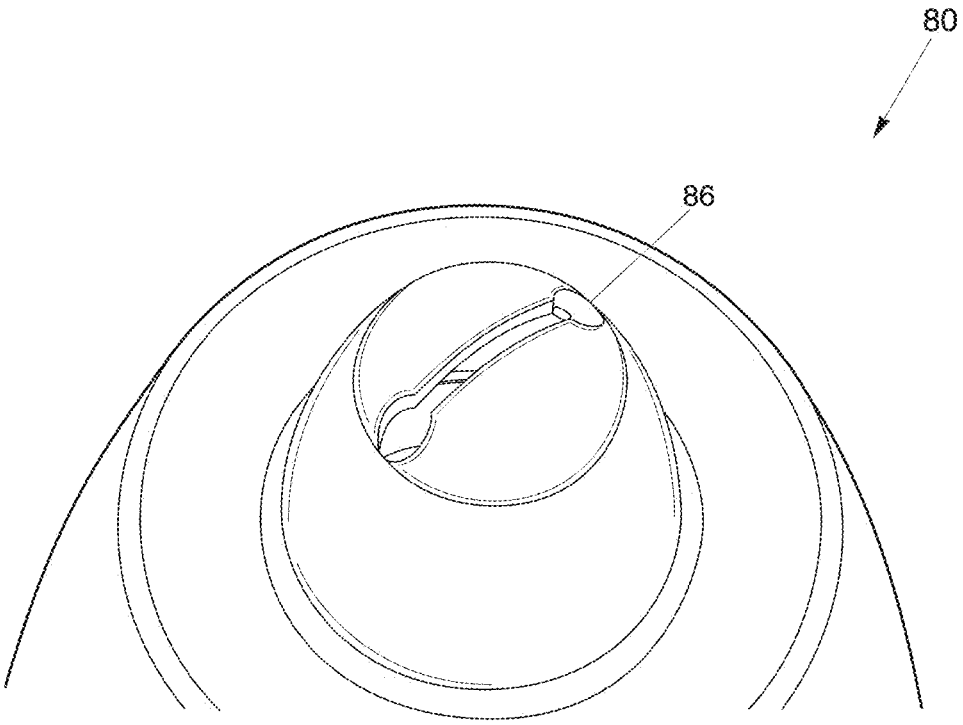
FIG. 16 is a top view of the dispensing closure of FIG. 9 including an exit orifice having a dumbbell shape.
Figure 17:
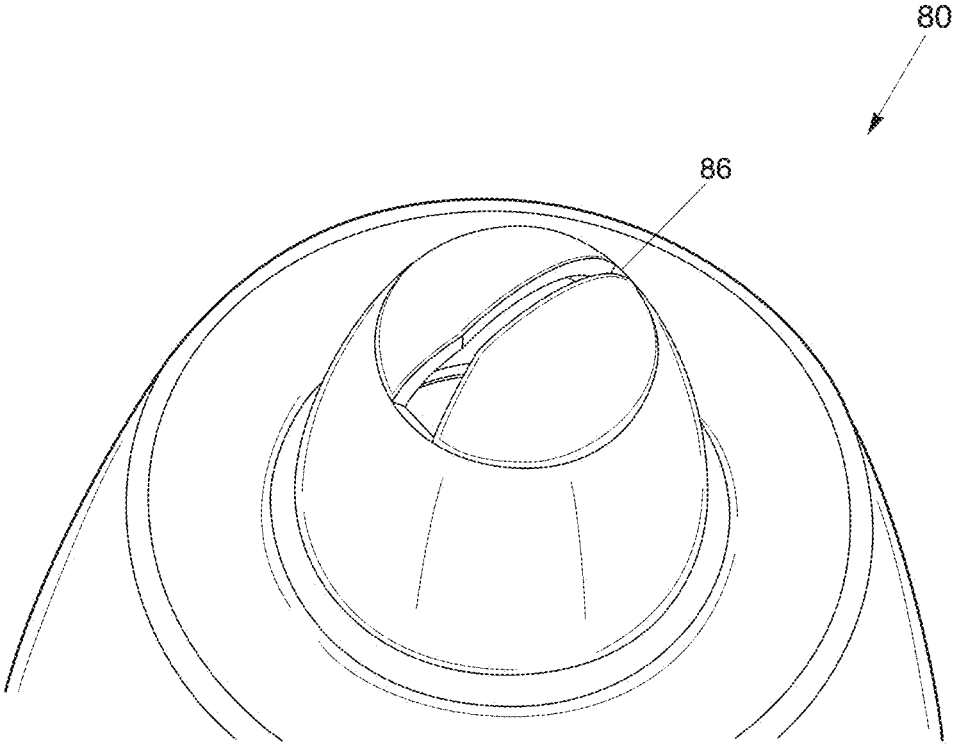
FIG. 17 is a top view of the dispensing closure of FIG. 9 including an exit orifice having a half bowtie shape.
Figure 18:
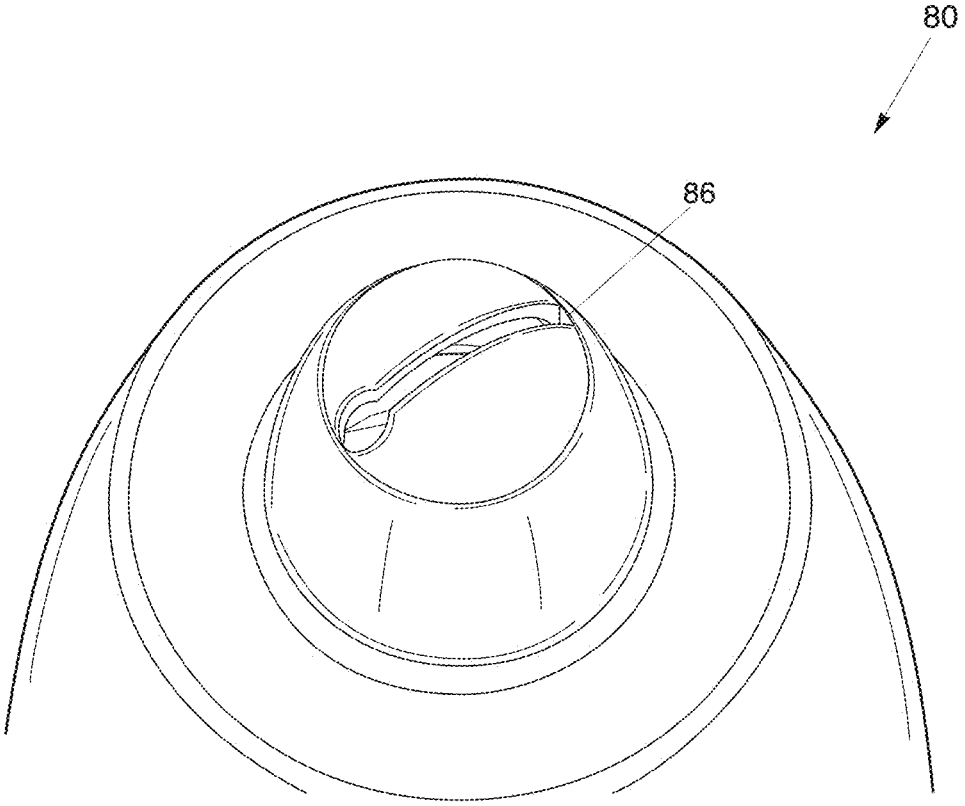
FIG. 18 is a top view of the dispensing closure of FIG. 9 including an exit orifice having a fan keyhole shape.
Figure 19:
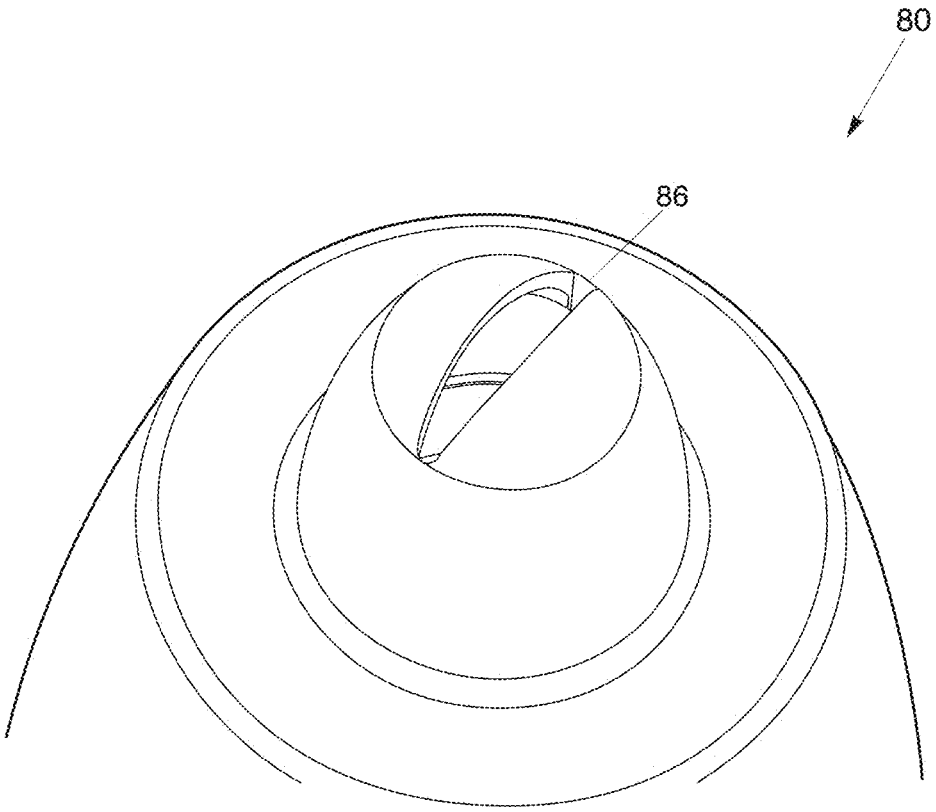
FIG. 19 is a top view of the dispensing closure of FIG. 9 including an exit orifice having an oval shape.

Referring to FIG. 11, in a second sealing mechanism for a dispensing closure 80 having an insert member 84, a sealing member portion 96 of the sealing tube portion 90 is positioned at an upper area of the insert member 84. The sealing member portion 96 engages an interior of the flow conduit 92 when the closure body 82 is rotated into in a closed position to contact the sealing tube portion 90. The interior of the flow conduit 92 includes a seal bead 98 to frictionally engage the sealing member portion 96 to prevent the flow of liquid out of the exit orifice 86. Alternatively, the sealing member portion 96 includes the seal bead to frictionally engage the interior of the flow conduit 92. Referring to FIGS. 12-13, when the dispensing closure is rotated into an open position, the closure body 82 disengages from contact with the insert member 84 to allow the flow of liquid through the exit orifice 86.

Referring to FIGS. 14-19, the dispensing closure 80 can provide a fan-type discharge using multiple configurations of the dispensing orifice 86. Other shapes of the exit orifice 86 that may be used are, for example, a bowtie shape (FIG. 14), curved rectangular shape (FIG. 15), dumbbell shape (FIG. 16), half bowtie shape (FIG. 17), keyhole shape (FIG.

18), oval shape (FIG. 19), "J" shape, "T" shape, inverted "T" shape, inverted "J" shape, and other non-circular shapes As shown generally in FIGS. 1-8, the dispensing closure 10A, 10B, 40, 60 may have a lid which is attached to the dispensing closure by a hinge mechanism, such as a living hinge. Also, referring to FIG. 3, the dispensing closure 10B may include a latching flange 11 near the hinge mechanism. When the lid 14 is pivoted about the hinge, the latching flange 11 extending from the closure lid 14 may engage a portion of the closure body 12 to facilitate an open position of the lid 14.

Figure 5:
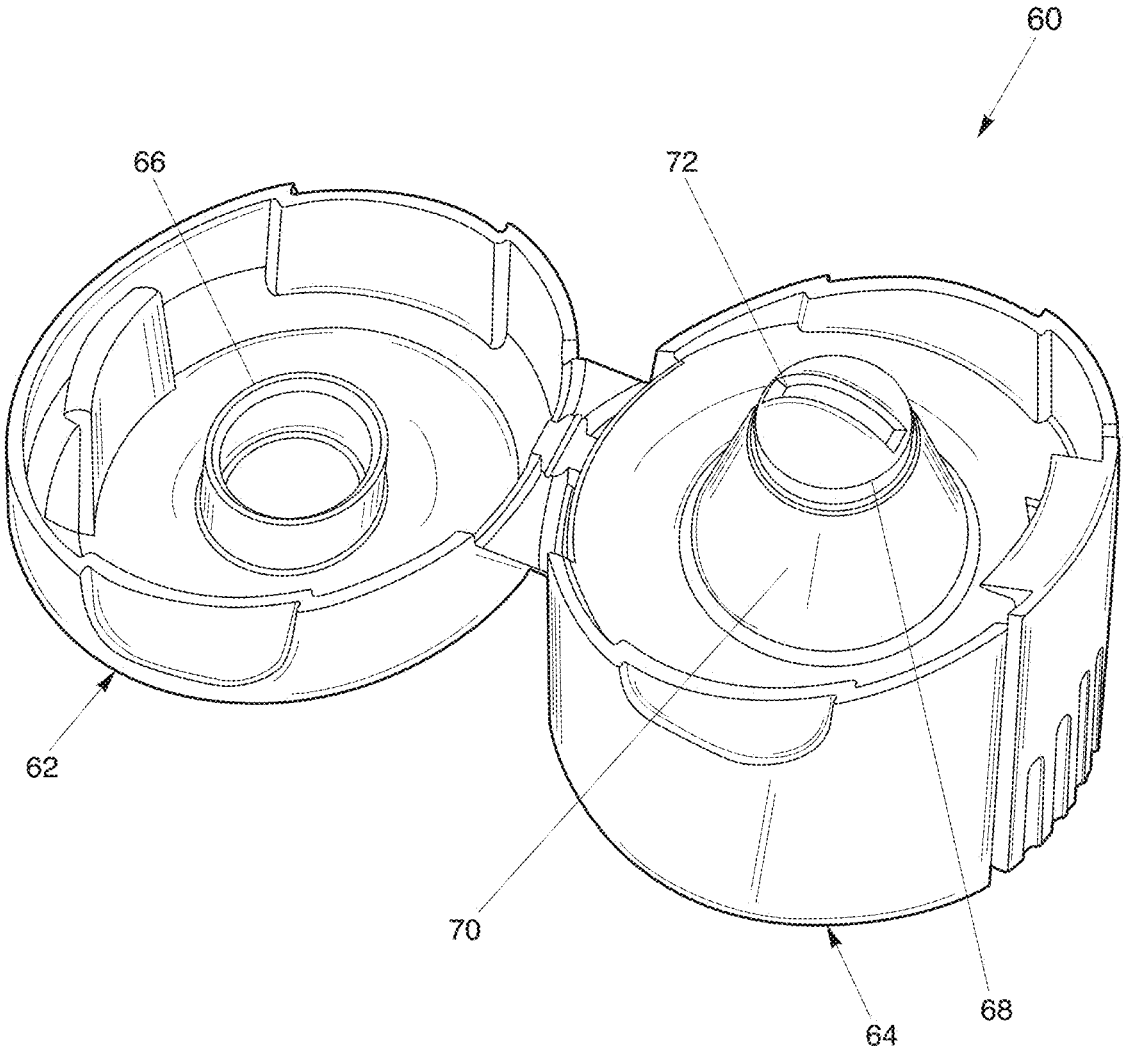
FIG. 5 is a perspective view of a dispensing closure with a closure lid having an interior circular wall for closing the exit orifice.

As shown generally in FIGS. 1-8, the dispensing closure 10A, 10B, 40, 60 may also include various latching mechanisms for releasably securing the closure lid to the closure body. Referring to FIGS. 2 and 6, a dispensing closure is illustrated that includes a child-resistant latching mechanism. This latching mechanism features a double-walled skirt having diametrically opposing sides which are depressed, at a lower portion, before opening the closure lid hingedly connected to the closure. In operation, the dispensing closure disengages the lid from the closure body by pushing inwardly on the outer side wall of the skirt to move hook members on the closure body away from hook members on the closure lid and away from a central axis of the dispensing closure. Also, a single latching mechanism may also be used as shown in FIG. 5. It should be noted that FIGS. 1-8 show an example of one type of hinge mechanism and latching mechanism and that other types of lid configurations may be used in the present invention.

Figure 21:
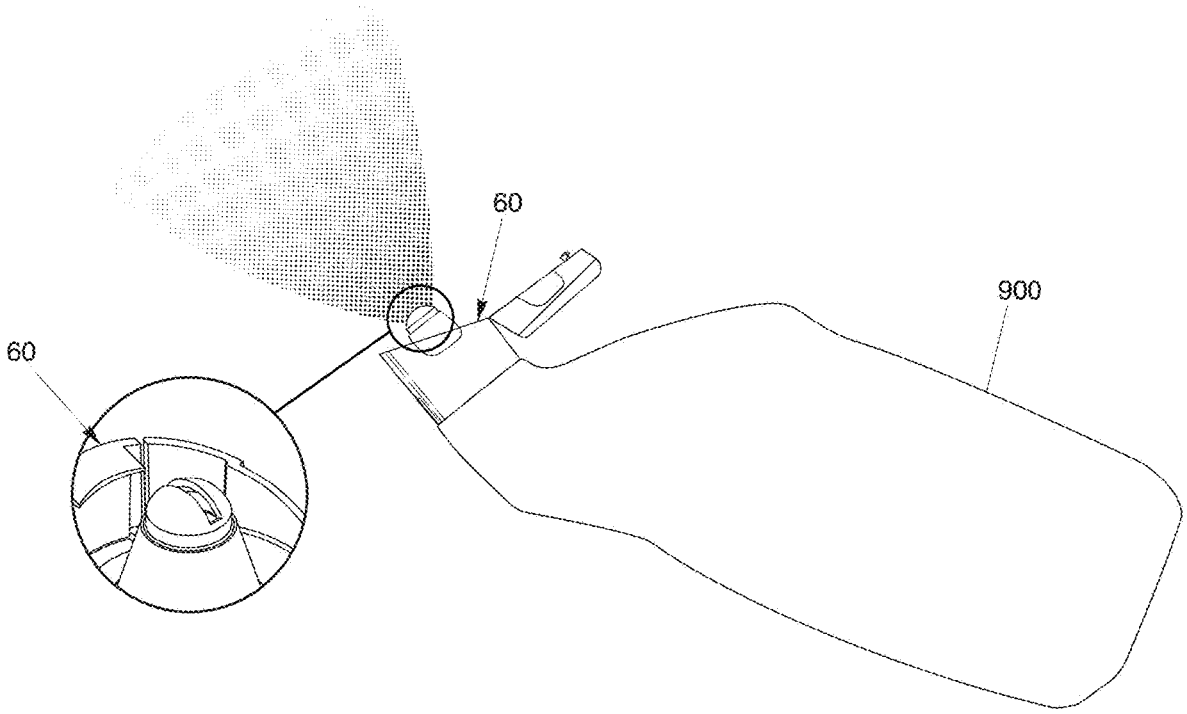
FIG. 21 is a side view of the dispensing closure of FIG. 5 attached to a squeeze-type product container with a partial perspective view of the dispensing closure of FIG. 5 in a cut-away.

Now referring to FIG. 21, in operation, the dispensing closure 60 of provides a fan-type spray or stream of liquid that fans out in a low pressure environment when the product container is squeezed. Note, any of the embodiments of the dispensing closure may be attached to the product container and this is merely an example. The low pressure environment may be less than 5 psi. In one embodiment, the dispensing closure is attached to a squeeze-type product container. When the squeeze-type product container has a force applied by a user, the liquid within the container moves through the flow conduit, collects within the tip portion to decelerate the velocity of the liquid, and discharges through the fan-type shaped exit orifice in a fan-type spray at less than 5 psi. In operation, the dispensing closure provides a stream of liquid that fans out when the product container is squeezed. Note, the purpose of the fan-type discharge is to provide a person who is cleaning, for example, a toilet bowl a wide stream of liquid to cover the desired portions of the bowl.

The flow path and velocity of the liquid through the dispensing closure during operation provides a fan-type spray in a low-pressure environment. Upon applying pressure to product container full of liquid, the liquid moves from an interior of the product container and into an interior of the dispensing closure attached to the product container. The liquid then accelerates into the flow conduit. The flow conduit has a gradually decreasing diameter which funnels the liquid into the tip portion where it temporarily collects or pools in the interior volume of the raised non-planar surface. The purpose of the raised non-planar surface is to maintain a continuous flow of the liquid discharge while it exits through the shaped exit orifice in a fan-type discharge.

Referring to FIGS. 1-8, the dispensing closure with the closure lid, or one-piece molded closure, operates in the following manner. To open the dispensing closure, the user depresses the sides of the closure body to release the closure lid whereby the closure lid is moved into an open position. Next, the user squeezes the product container to provide a discharge of liquid through the exit orifice of the flow conduit in a fan-type spray. To close the dispensing closure, the user snappingly engages the lid over the closure body.

Referring to FIGS. 9-13, the dispensing closure with the insert member, or two-piece molded closure, operates in the following manner. To open the dispensing closure, a user rotates or turns the closure body relative to the stationary insert member to remove the sealing tube away from sealing engagement with the exit orifice. Next, the user squeezes the product container to discharge liquid through the exit orifice in a fan-type spray. To close the dispensing closure, the user rotates or turns the closure body relative to the stationary insert member to return the sealing tube in sealing engagement with the exit orifice.

Figure 20:
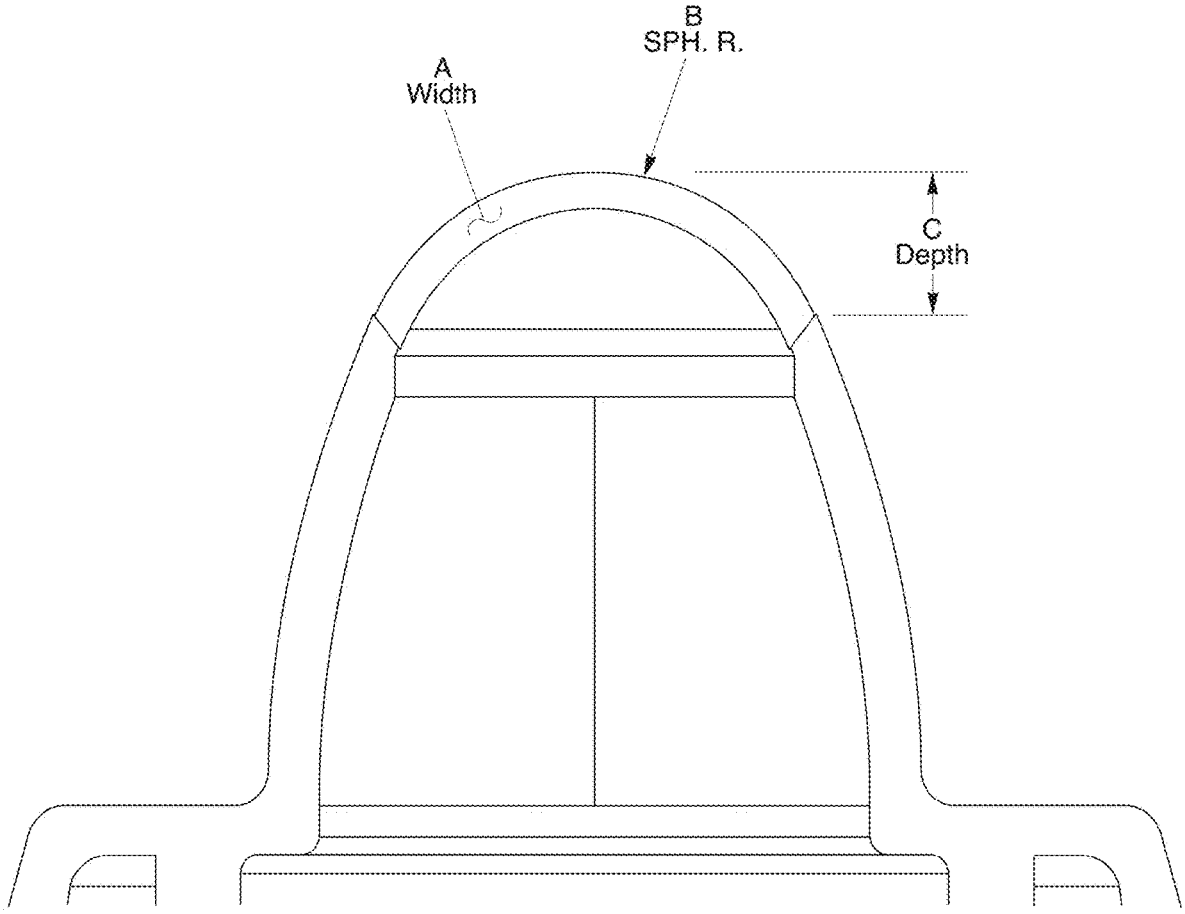
FIG. 20 is a cross-sectional view of a dispensing closure illustrating a tip portion with width (A), depth (C), and radius of exit orifice (B)

It is to be noted that the dimensions and shape of the dispensing closure, flow conduit, tip portion, and exit orifice are adjustable depending upon the viscosity of the product stored within an interior of the product container. Referring to FIG. 20, an example of a tip portion is illustrated which defines a width (A), depth (C), and radius (B) of said exit orifice which are adjustable according to the viscosity of the liquid and desired dimension of the fan-type discharge. For example, for a low viscosity liquid, it may be desirable for a flow conduit with smaller dimension to achieve a lower flow volume. Conversely, it may be desirable for a flow conduit with large dimensions for a highly viscous product to achieve a higher flow volume.

In view of the foregoing, a dispensing closure is provided related to container closures, and more particularly to squeeze-type container dispensing closures. This invention relates to a dispensing closure for dispensing liquid with varying degrees of viscosity. More specifically, it relates to a dispensing closure defining an orifice in the closure to produce a fan-type discharge or spray in a low-pressure environment.

Referring to FIGS. 22-36, a two-piece dispensing closure 100A, 100B, in another embodiment, incorporates the advantages and benefits of the above-mentioned dispensing closures 10A, 10B, 40, 60, 80 (FIGS. 1-21) defining an exit orifice 116 to produce a fan-type discharge or spay in a low-pressure environment. The two-piece dispensing closures 100A, 100B further include two pairs of opposing stopping tabs which cooperate with a single pair of opposed stopping lugs on a neck 910 of a container 900 to provide a child-resistant mechanism, which are further explained herein.

As shown generally in FIGS. 22-36, the present invention is generally directed to a novel dispensing closure for squeeze-type containers. Most importantly, as shown in FIG. 23, the dispensing closure 100A, 100B has an exit orifice 116 defined in a tip portion 118 of the flow conduit 120. The tip portion 118 includes a raised non-planar surface which allows for a collection of liquid before discharging liquid in a fan-type spray through the exit orifice 116 in a low pressure environment.

Figure 22:
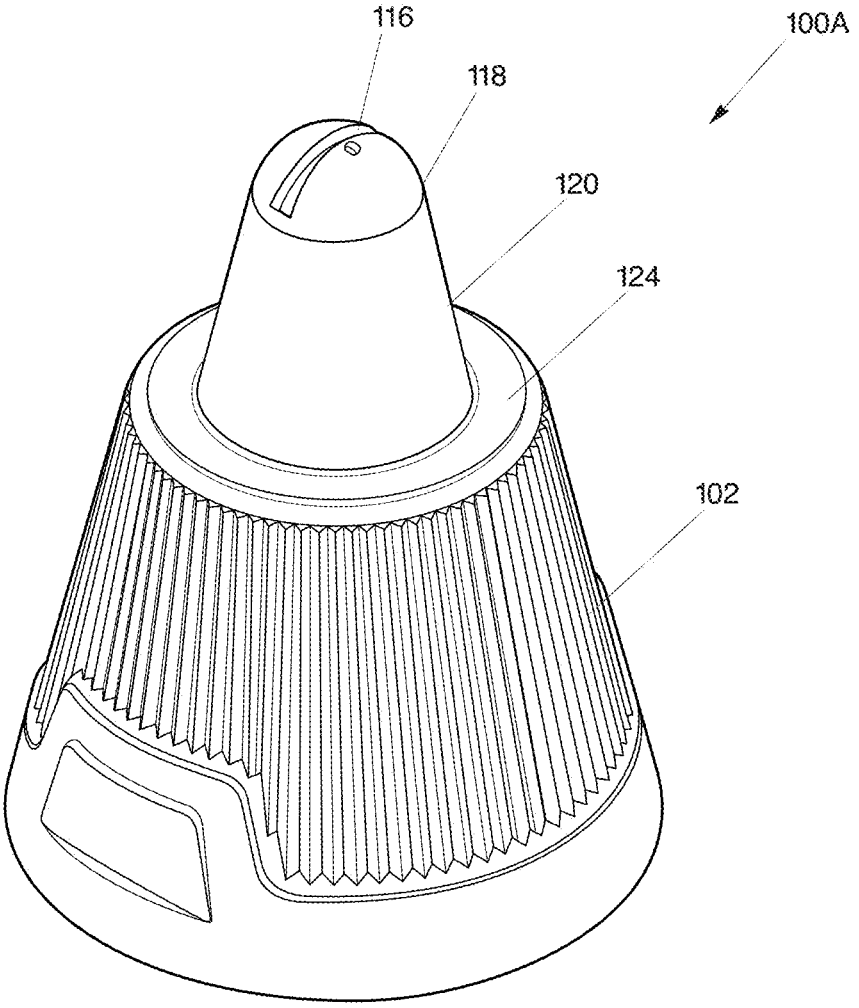
FIG. 22 is a perspective view of a two-piece dispensing closure with an insert member.
Figure 23:
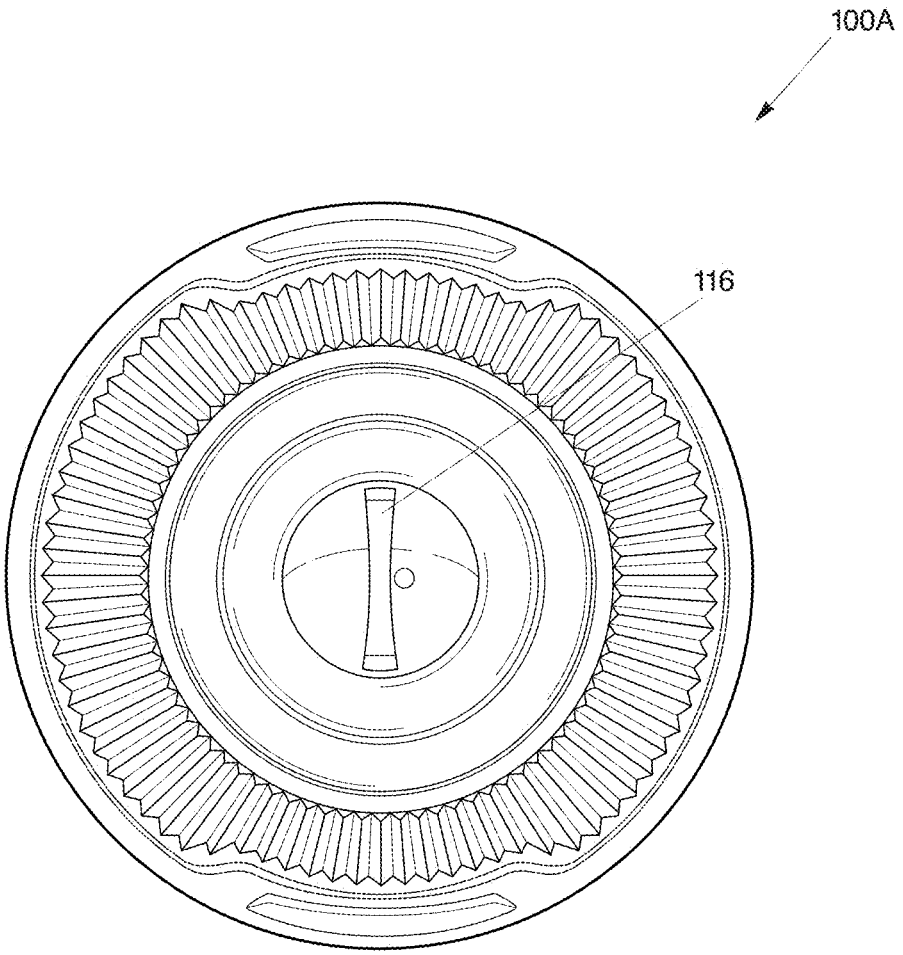
FIG. 23 is a top view of the dispensing closure of FIG. 22.
Figure 24:
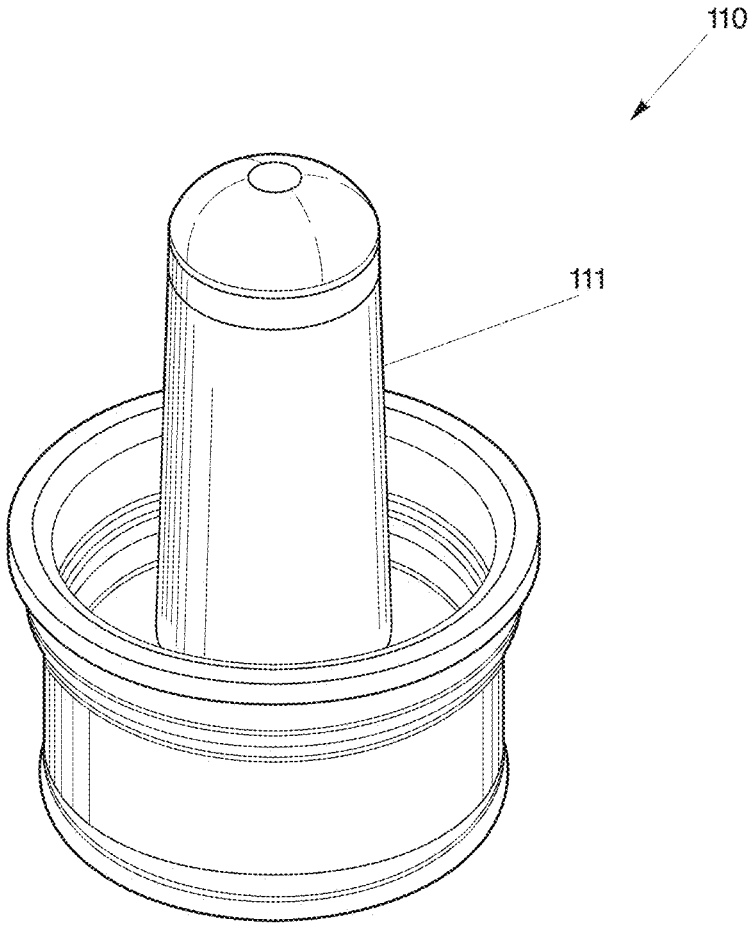
FIG. 24 is a perspective view of the insert member of FIG. 22.
Figure 25:
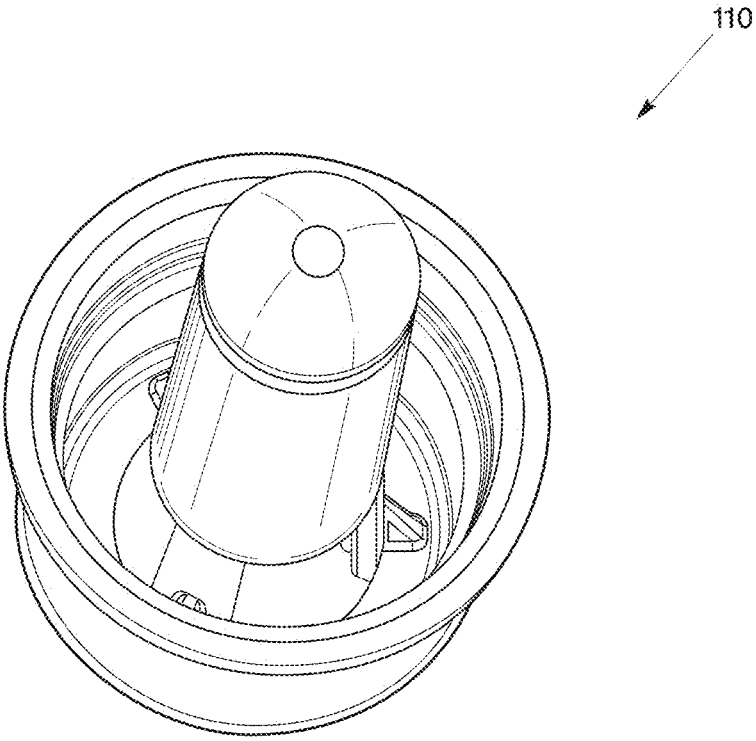
FIG. 25 is a top perspective view of the insert member of FIG. 24.
Figure 26:
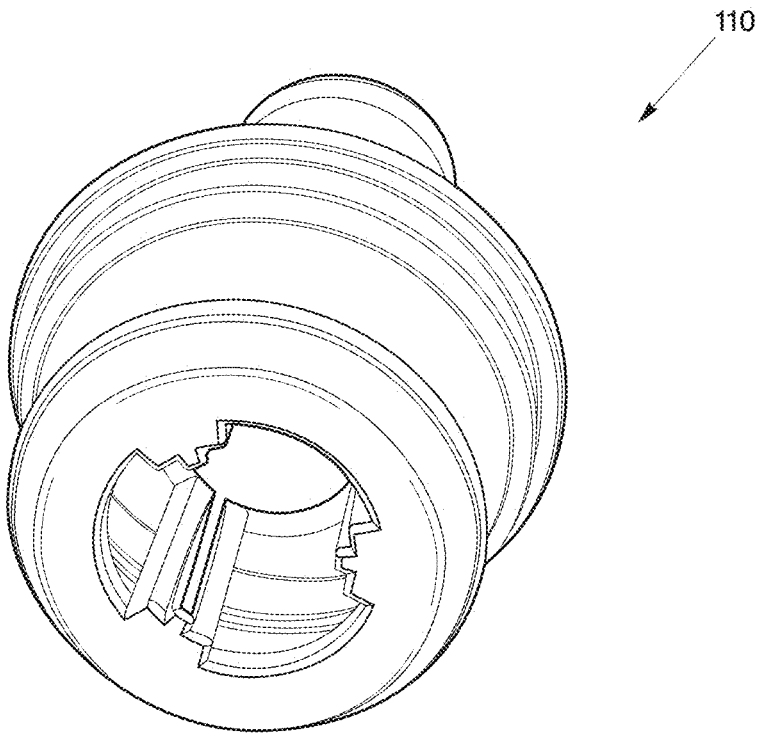
FIG. 26 is a bottom perspective view of the insert member of FIG. 24.
Figure 27:
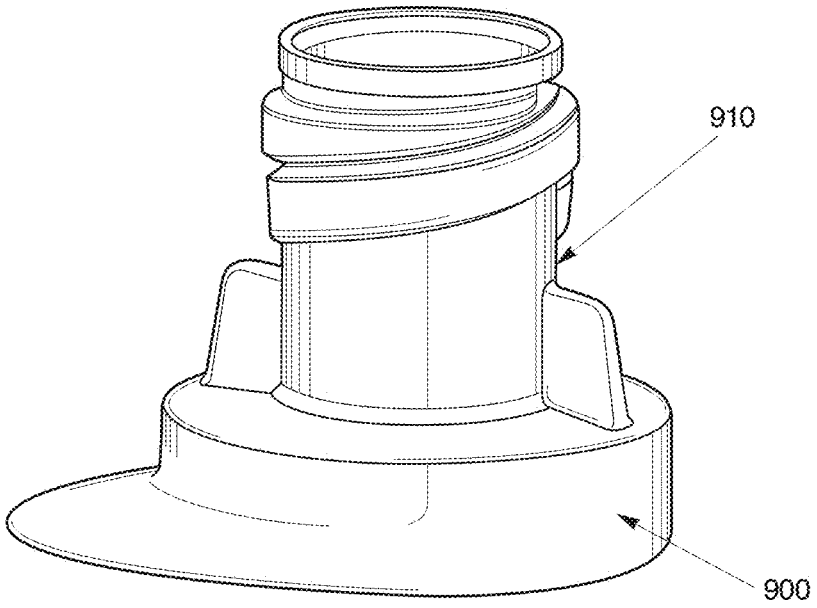
FIG. 27 is a perspective view of a neck of a bottle for engagement with the two-piece dispensing closure of FIG. 22.
Figure 28:
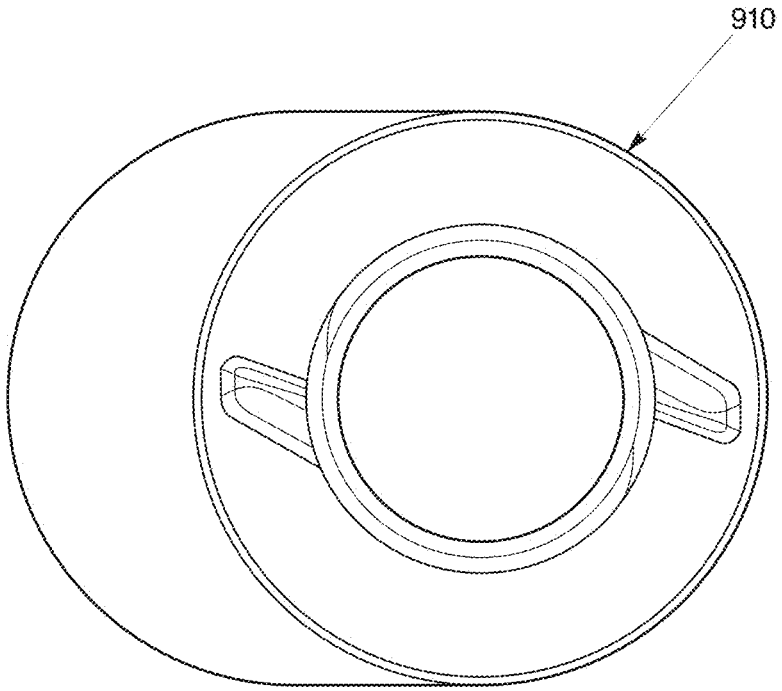
FIG. 28 is a top view of the neck of FIG. 27.
Figure 29:
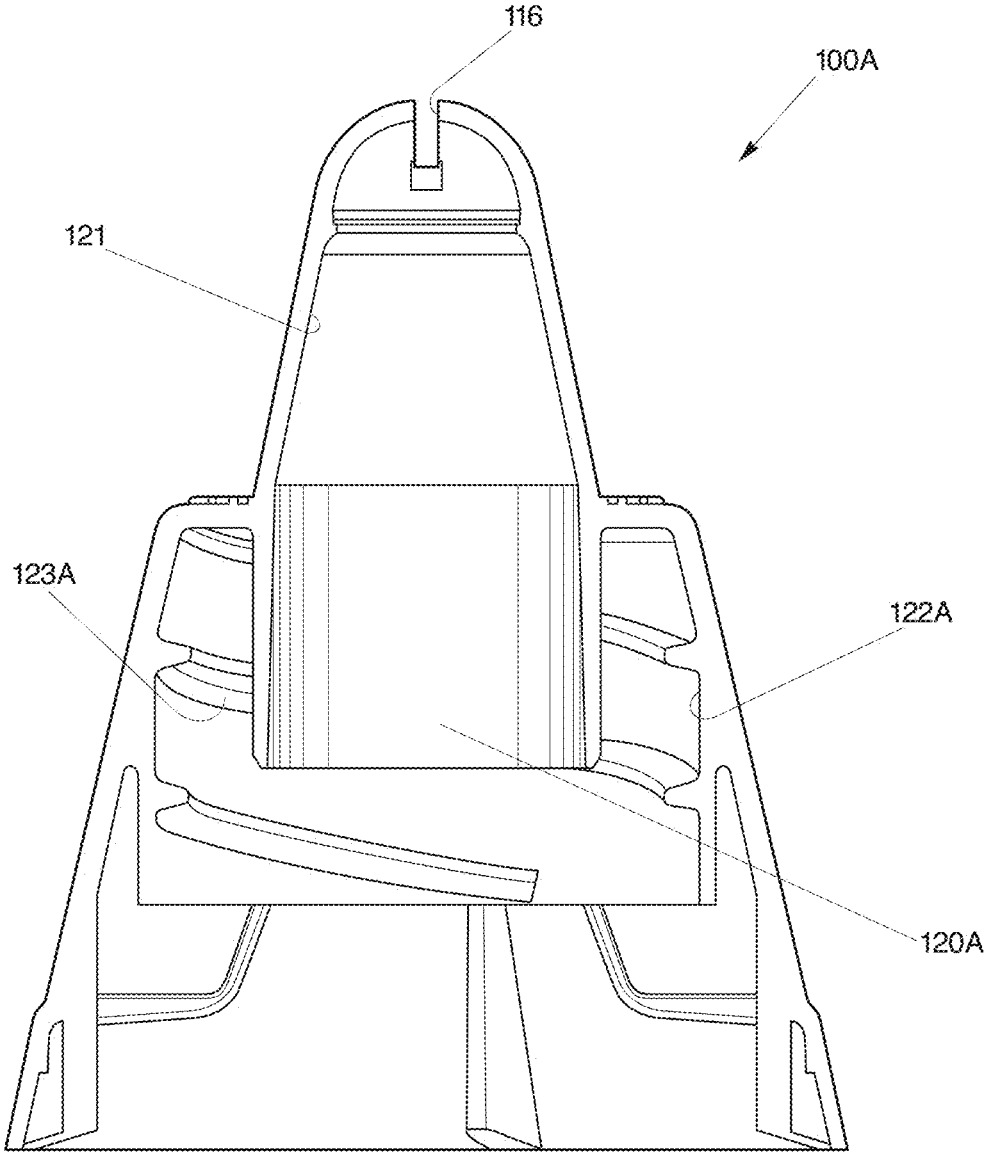
FIG. 29 is a cross-sectional view of the dispensing closure of FIG. 22.
Figure 33:
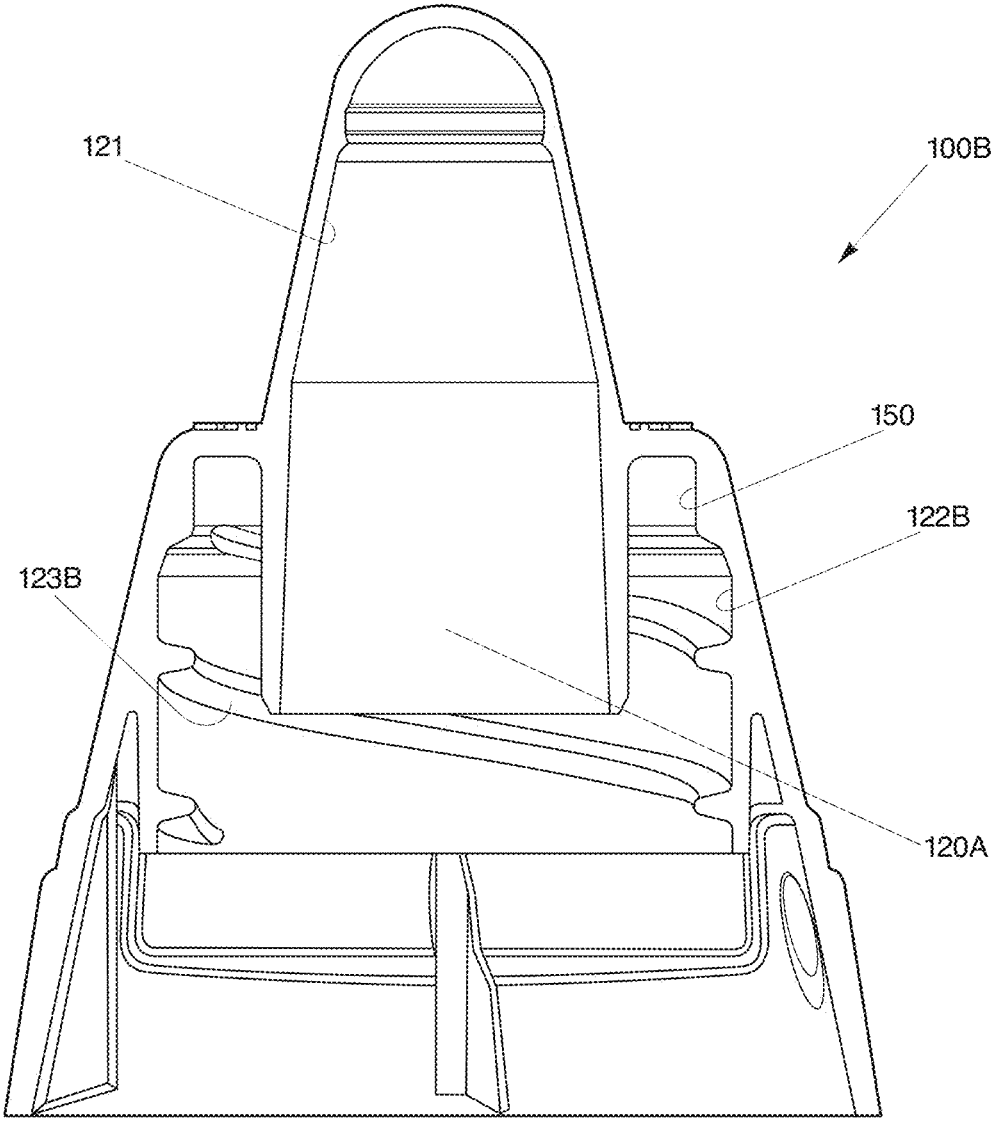
FIG. 33 is a cross-sectional view of a two-piece dispensing closure having a capture ring.

Referring to FIG. 22, the dispensing closure 100A, 100B includes a closure body 102 having an upper deck 124 and a skirt 122 depending from the upper deck 124 where the skirt 122A, 122B is configured and arranged to attach to a product container 900, such as squeeze-type product container 900 or inverted-type container (not shown). Referring to FIGS. 29 and 33, the skirt 122A, 122B includes threads 123A, 123B for threaded mounting on an open end or neck of a product container.

Referring to FIGS. 29 and 33, a flow conduit 120 extends from an interior of the closure body 102 and through the upper deck 124 to provide a flow path from an interior of the closure 100A, 100B to an exterior of the closure 100A, 100B. The flow conduit 120 has an entrance orifice 120A within the interior of the closure body 102 and an exit orifice 106 outside the exterior of the closure body 102. In one embodiment, the flow conduit 120 is raised in an elongated manner outside the exterior surface of the closure body 102. The flow conduit 120 has an inner wall 121 extending between the entrance orifice 120A and the exit orifice 116. The inner wall 121 is inclined to funnel liquid from an interior of the closure body 102 to the tip portion 118.

The flow conduit 120 includes the tip portion 118 for facilitating the production of a fan-type spray through the exit orifice 116. The tip portion 118 includes the raised non-planar surface having an interior volume to collect liquid before the liquid exits through the exit orifice 116 under low pressure. The collection of liquid within an interior volume of the raised non-planar surface provides a continuous and even flow of liquid as it exits through the exit orifice 116.

The tip portion 118 defines a shape of the exit orifice 116 which facilitates the production of the fan-type spray. Referring back to FIG. 23, the exit orifice 116 is defined along a diameter of a non-planar surface of the flow conduit 120 and the orifice 116 has a substantially rectangular shape. The rectangular exit orifice 16 has a non-uniform width to provide a non-uniform thickness and width of the fan-type spray when it exits through the exit orifice 116. Also, it should be noted that to produce a continuous fan-type spray, the exit orifice 116 may also define a uniform width, especially for the rectangular shape, and the tip portion 118 may have a relatively uniform thickness of material.

More specifically referring to FIGS. 22-36, in a two-piece dispensing closure 100A having an insert member 110 and a closure body 102, the dispensing closure 100A includes multiple sealing mechanisms similar to those disclosed in dispensing closure 80 to prevent liquid from exiting through the exit orifice 106. The dispensing closure 100A includes the insert member 110 positioned within the open end of the product container 900. The insert member 110 includes an insert base for seating within the open end of the product container 900. The insert member 110 also includes a sealing tube portion 111 extending upwardly from the insert base to occupy an interior volume of the flow conduit 120.

In a first sealing mechanism for a dispensing closure 100A having an insert member 110, the sealing tube portion 111 includes a mating surface corresponding to an interior surface of the tip portion 118. When the closure body 102 is rotated into a closed position to contact the sealing tube portion 111 with the interior surface of the tip portion 118, the liquid is prevented from discharging through the exit orifice 106.

Figure 30:
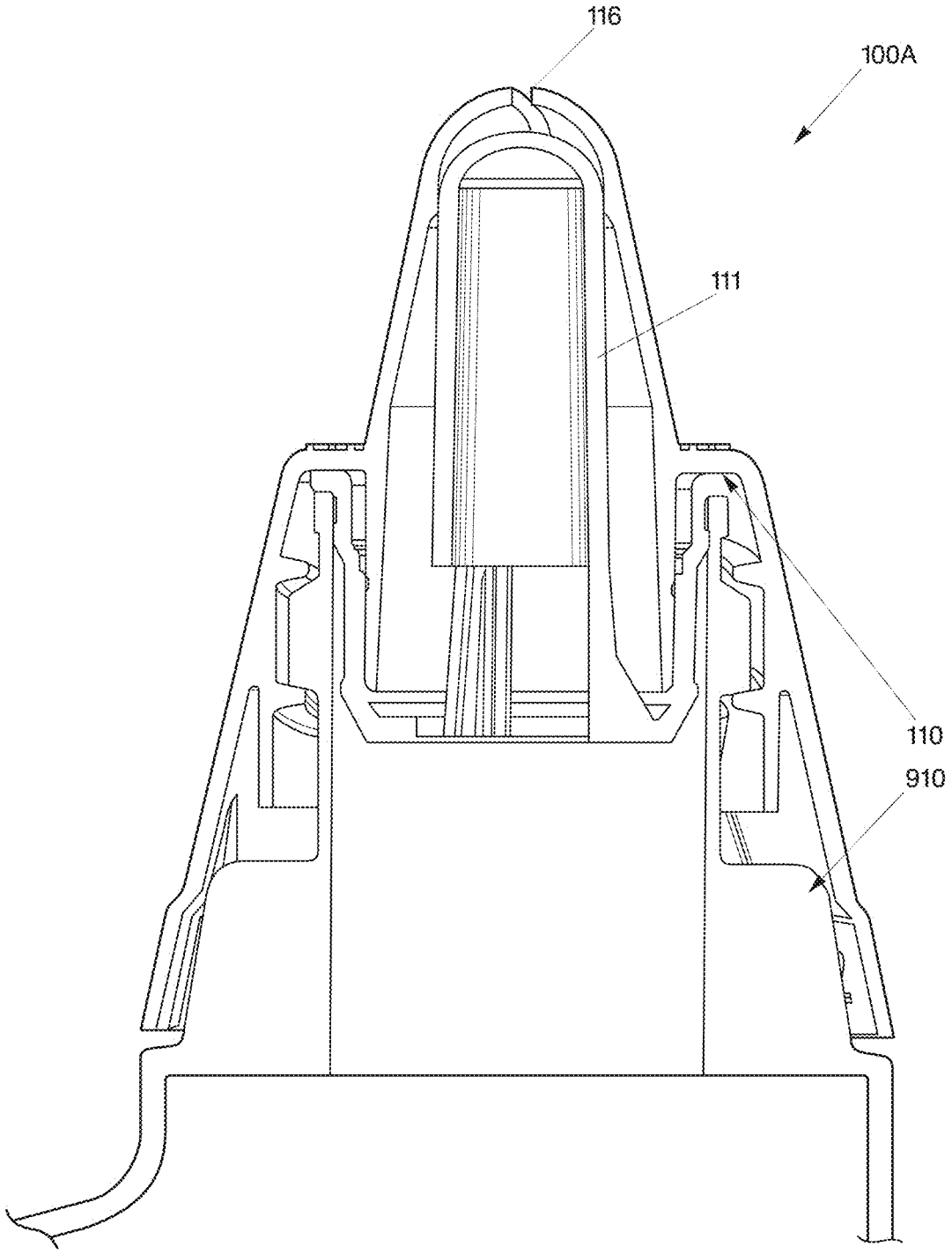
FIG. 30 is a cross-section view of the assembled dispensing closure of FIG. 22 attached to the neck of the bottle.
Figure 31:
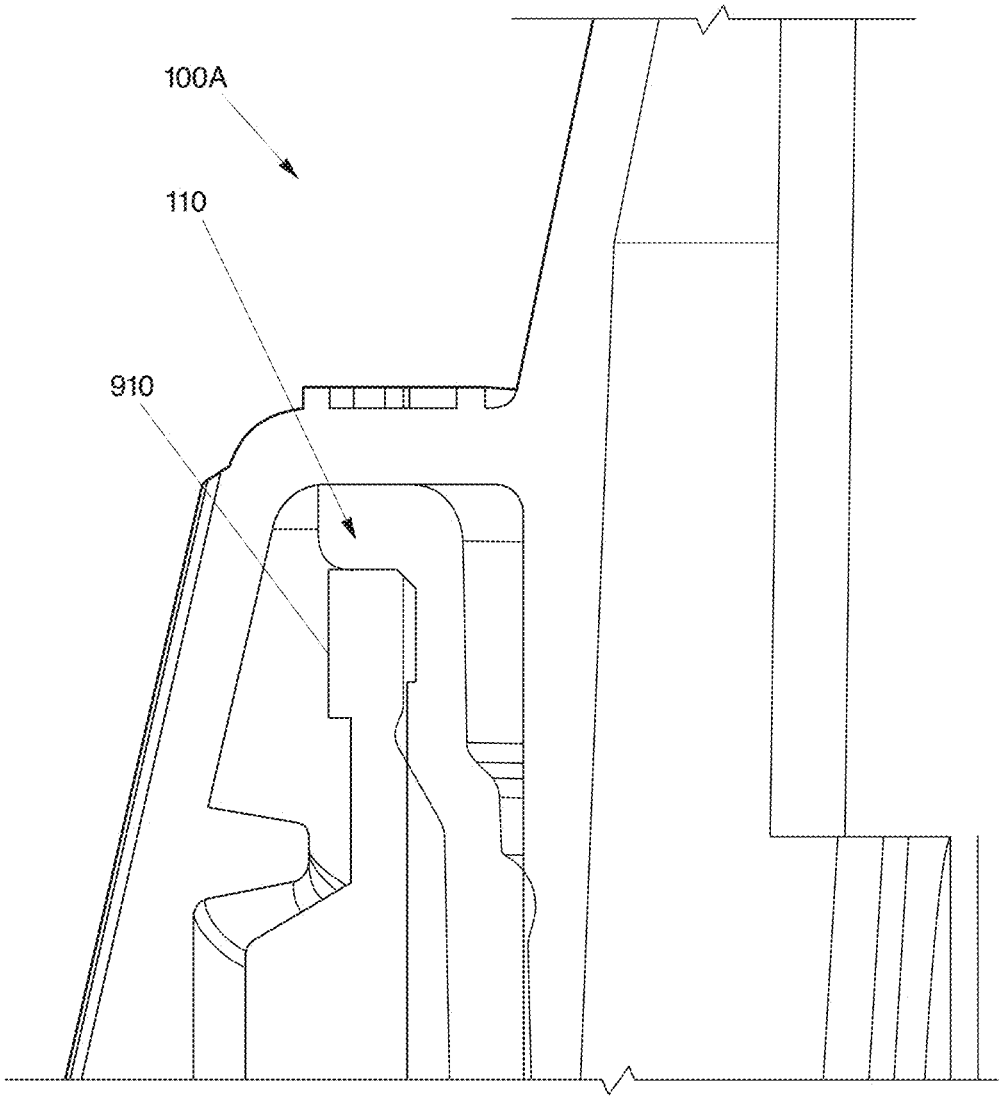
FIG. 31 is an isolated view of an upper portion of the assembled dispensing closure of FIG. 30.
Figure 32:
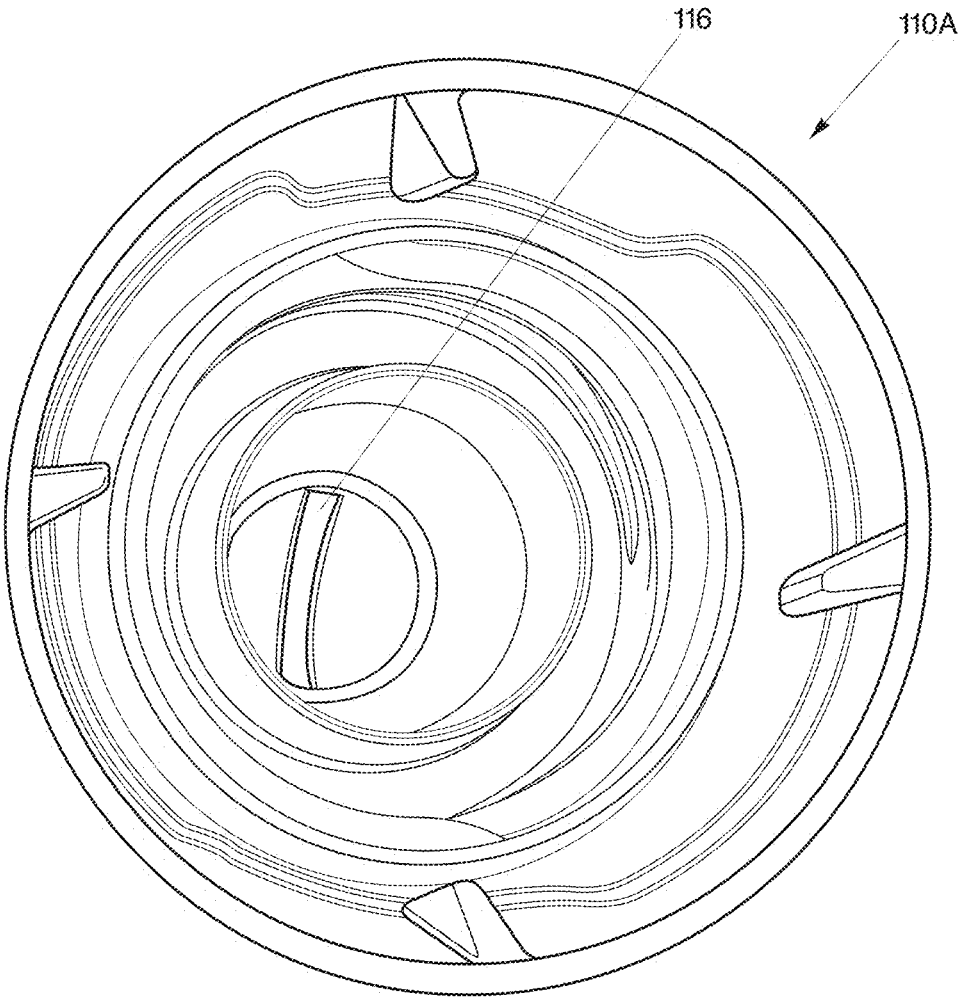
FIG. 32 is bottom view of the dispensing closure of FIG. 22.

Referring to FIG. 30, in a second sealing mechanism for a dispensing closure 100A having an insert member 110, a sealing member portion of the sealing tube portion 111 is positioned at an upper area of the insert member 110. The sealing member portion engages an interior of the flow conduit 120 when the closure body 102 is rotated into in a closed position to contact the sealing tube portion 111. The interior of the flow conduit includes a seal bead to frictionally engage the sealing member portion to prevent the flow of liquid out of the exit orifice 106. Alternatively, the sealing member portion includes the seal bead to frictionally engage the interior of the flow conduit 120. When the dispensing closure is rotated into an open position, the closure body 102 disengages from contact with the insert member 110 to allow the flow of liquid through the exit orifice 106.

The dispensing closure 100A, 100B includes a threaded container finish or neck 910, an insert member 110 received inside the opening of the container finish, with the dispensing closure 100A, 100B threadably received on the container neck 910 so that the dispensing closure is rotatable from a closed position to an open position. The dispensing closure 100A, 100B includes a flow conduit 120 with a rectangular slit-shaped orifice 116 effective for spraying a fan shaped pattern of liquid. The insert member 110 includes a sealing tube portion 111, which is positioned so that the opening in tip of the flow conduit 120 is sealed by the sealing tube portion 111 when the dispensing closure 100A, 100B is in the closed position.

Referring to FIG. 30, the dispensing closure 100A is illustrated as assembled and attached to neck of the container. When dispensing closure 100A and insert member 110 are assembled for attachment or engaging the neck of the bottle, the interference or engagement between the outer diameter of the insert member 110 and the inner diameter of the neck 910 may tend to spread out of the outer diameter of the neck of the bottle. This spreading out of the neck may over time continue to relax thereby reducing the interference or engagement which could result in an insert staying with a dispensing closure when it is opened instead of the bottle neck.

Figure 34:
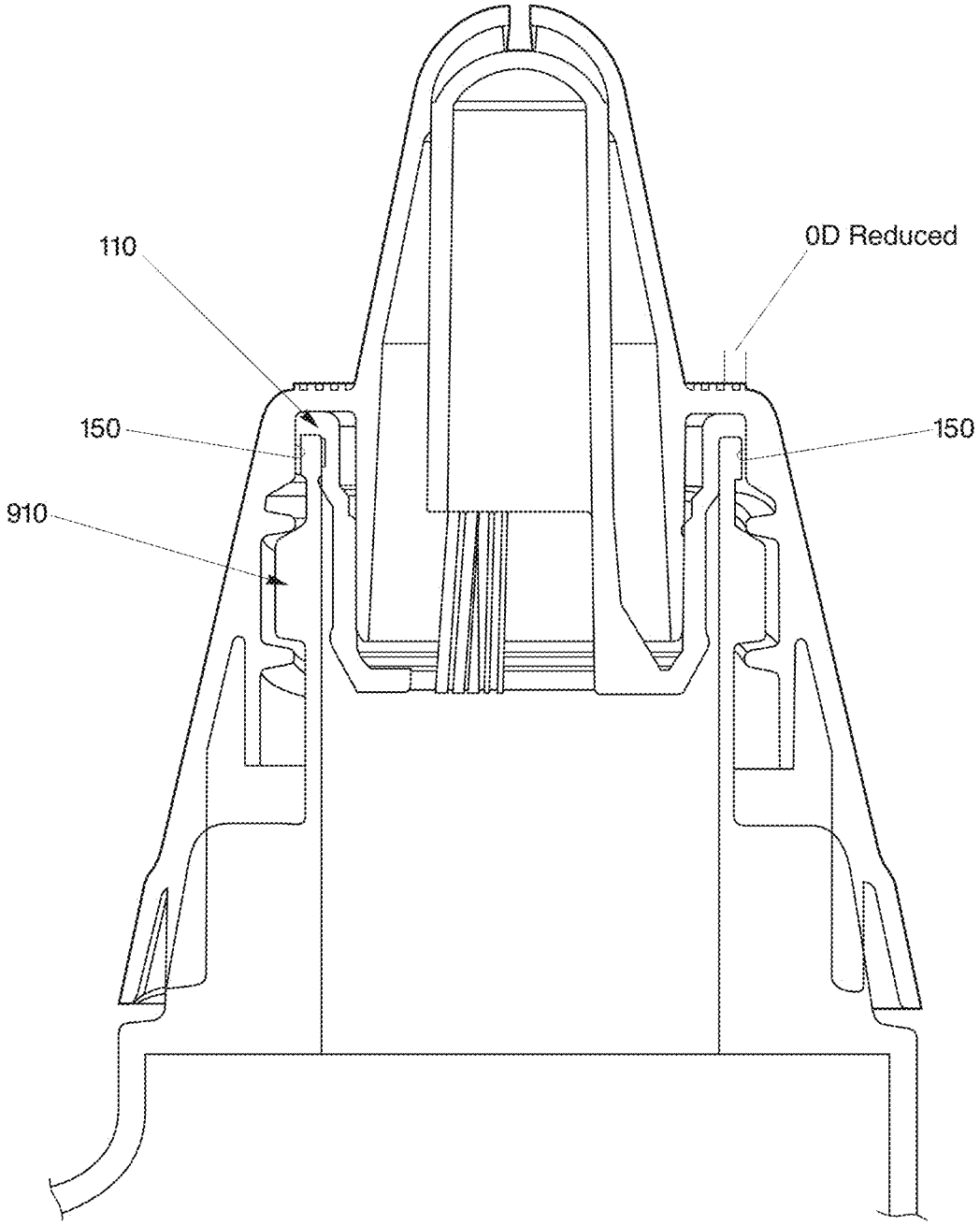
FIG. 34 is a cross-sectional view of the assembled two-piece dispensing closure of FIG. 33 attached to a neck of a bottle.
Figure 35:
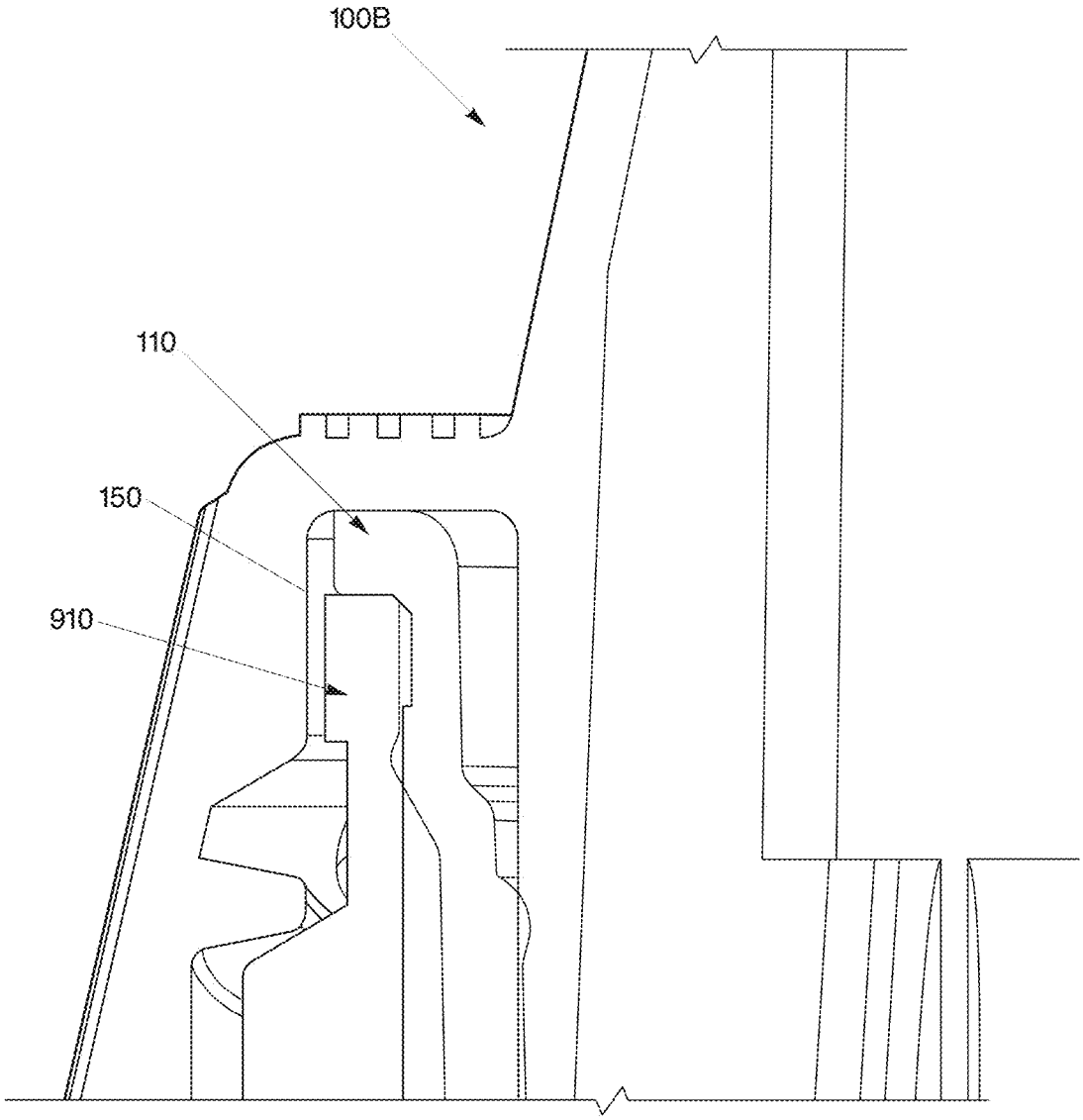
FIG. 35 is an isolated view of an upper portion of the assembled dispensing closure of FIG. 34.
Figure 36:
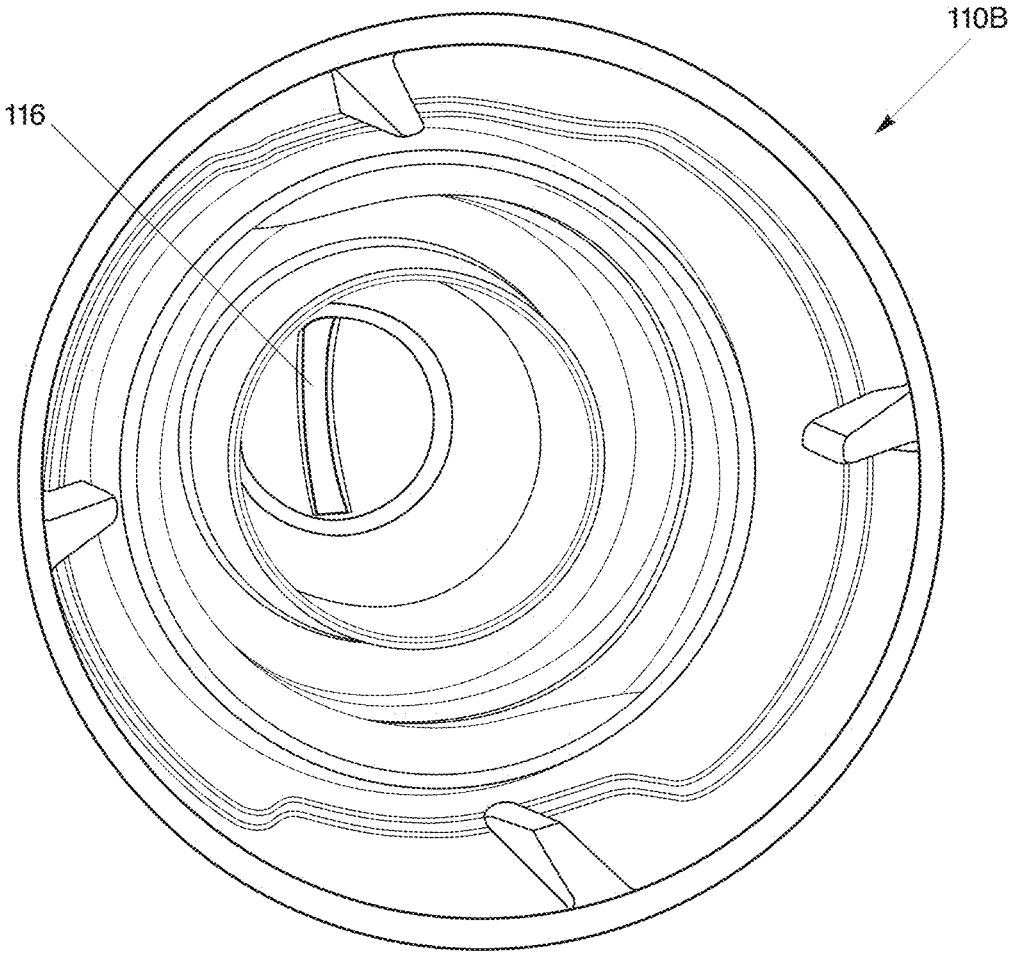
FIG. 36 is a bottom view of the dispensing closure of FIG. 33.

To reduce the spreading out of the bottle outer diameter, a thread section of an upper portion of the dispensing closure 100B, as illustrated in FIGS. 33-34, is removed thereby defining a capture ring 150. This capture ring 150 captures or holds the bottle neck and insert member in place which minimizes the initial spreading and stops any post relaxation. Upon the initial opening of the dispensing closure, the capture ring 150 maintains contact with the bottle neck and inserts member outer diameter allowing seal surfaces to break free from insert member forcing it to stay within the bottle neck. Note, the first sealing mechanism is totally disengaged before capture ring is moved up far enough to be released from the insert and bottle outer diameter. In addition, the outer diameter of the insert member may be reduced to facilitate operation of the capture ring.

The dispensing closure 100A, 100B generally includes an upper wall from which the flow conduit projects upwardly and an inner wall extending downwardly from the upper wall. The inner wall is threadably received onto the container neck. Finally, the dispensing closure includes an outer shell wall or skirt depending downwardly and outwardly from the upper wall. The threads of the container neck and inner wall of the dispensing closure are a double thread design where the cap can be moved from a fully closed position to an operative open position by rotation of approximately 90 degrees. Complete removal of the dispensing closure from the neck requires a rotation of more than 270 degrees from fully engaged to fully disengaged.

The dispensing closure 100A, 100B also includes two pairs of opposing stopping tabs on the inner surface of the outer wall, which cooperate with a single pair of opposed stopping lugs on the container finish. A first, opposed pair of stopping tabs function as child resistant latches to resist movement of the dispensing closure from the closed position to the open position. In operation, the dispensing closure must be squeezed at opposing locations (identified with thumb pads) on the dispensing closure to deform the dispensing closure and move the CR tabs outwardly to overcome the stop lugs. Once freed from the stop lugs, the dispensing closure can then rotate 90 degrees where the second set of stopping tabs engages with the stop lugs to prevent further rotation. This second set of stopping tabs prevents complete removal of the dispensing closure from the container finish.

Referring to FIGS. 22-36, the dispensing closure 110A, 110B can provide a fan-type discharge using multiple configurations of the dispensing orifice 106 other than substantially rectangular. Other shapes of the exit orifice 106 that may be used are, for example, a bowtie shape (FIG. 14), curved rectangular shape (FIG. 15), dumbbell shape (FIG. 16), half bowtie shape (FIG. 17), keyhole shape (FIG. 18), oval shape (FIG. 19), "J" shape, "T" shape, inverted "T" shape, inverted "J" shape, and other non-circular shapes.

Figure 37:
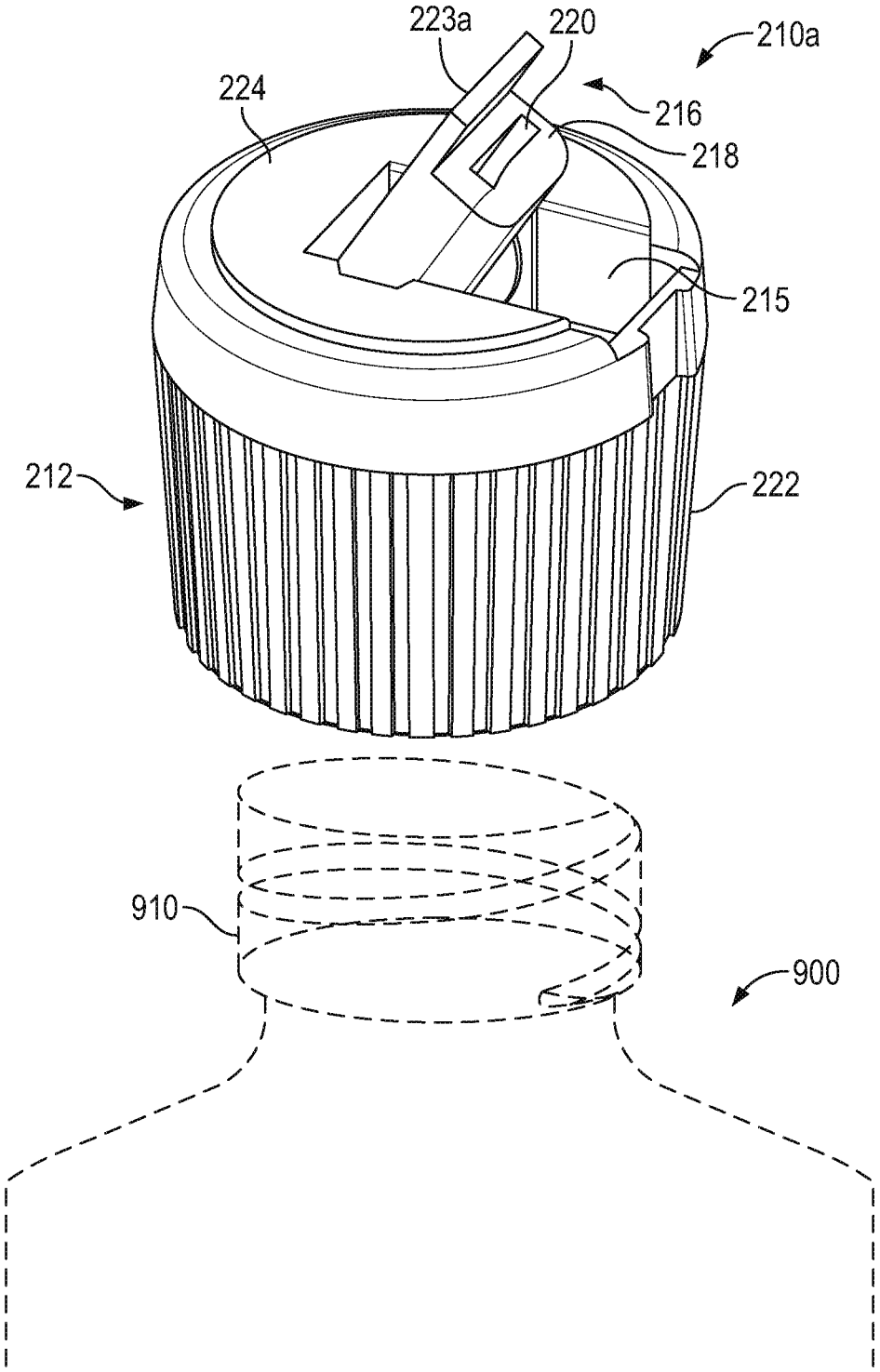
FIG. 37 is a perspective view of a dispensing closure with a pivoting spout.

FIG. 37 shows another dispensing closure 210A for a squeeze-type container which produces a fan-type spray in a low pressure environment. Dispensing closure 210A may include a closure body 212 having an upper deck 224 and a skirt 222 depending from the upper deck 224 where the skirt 222 is configured and arranged to attach to a product container 900, such as squeeze-type product container 900 or inverted-type container (not shown). As previously shown in FIG. 3, the skirt 222 includes internal threads for threaded mounting on an open end or neck of a product container 900 (illustrated in dotted lines). However, it is to be understood that other skirt mounting arrangements are also contemplated within the scope of the invention, and the invention should not be limited to the inwardly threaded skirt as the singular means for mounting. Furthermore, the skirt 222 may be a singular or double walled skirt.

A pivoting spout 223A is provided through which flow conduit 220 extends from an interior of the closure body 212 and through the upper deck 224 to provide a flow path from an interior of the closure 210A to an exterior of the closure 210A. The flow conduit 220 has an entrance orifice within the interior of the closure body 212 and an exit orifice 216 outside the exterior of the closure body 212. The flow conduit 220 may pass through spout 223A which pivots between a closed position generally within closure body 212 and an open position generally extending outward of closure body 212.

To move the spout 223A from a closed position to an open position, a user may pull upwardly on the end of spout 223A where it rests along the upper circumference of the closure body 212. The spout 223A may then be pivoted into its open position. To close spout 223A, it is merely pushed forward to pivot it downward and back into a recess 215 provided in the closure body 212.

Figure 38:
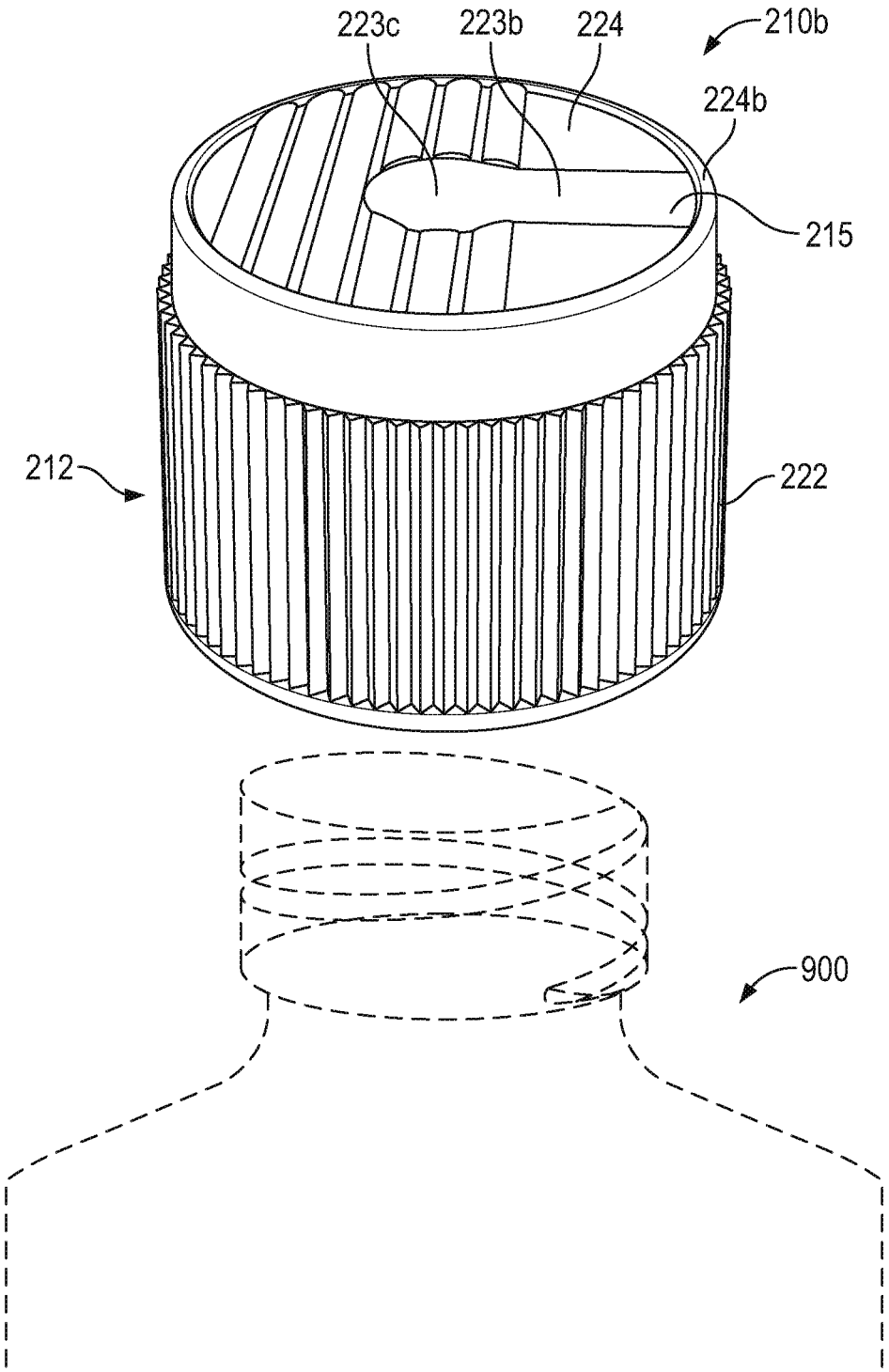
FIG. 38 is a perspective view of another dispensing closure with a pivoting spout.

FIG. 38 shows a dispensing closure 210B that, like dispensing closure 210A, also includes a pivoting spout 223B. The flow conduit 220 may pass through spout 223B which pivots between a closed position generally within closure body 212 and an open position generally extending outward of closure body 212. However, instead of spout 223B extending outward to or past the upper circumference of the dispensing closure, the spout 223B may stop short of the circumference. The upper circumference of the dispensing closure may thus have a lip 224B extending upward in front of the spout 223B to prevent lifting the spout at the exit orifice 216. This may provide a child resistant feature.

The pivoting end of spout 223B may be provided with protrusions 223C to enable a user to open the spout 223B. To move the spout 223B from a closed position to an open position, a user may pull on protrusions 223C to roll or pivot the spout to an open position. To close spout 223B, it is merely pushed forward to pivot it downward and back into a recess 215 provided in the closure body 212.

Figure 39:
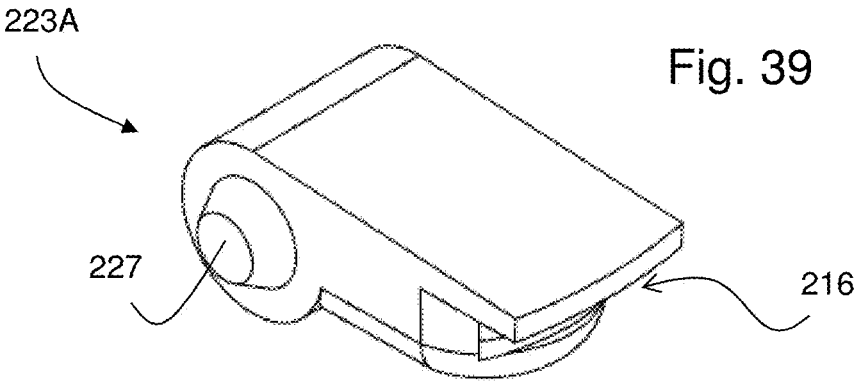
FIG. 39 is a perspective view of a pivoting spout of FIG. 37.
Figure 40:
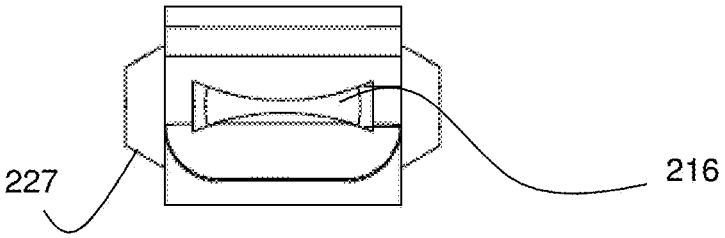
FIG. 40 is a front view of the pivoting spout of FIG. 37.
Figure 41:
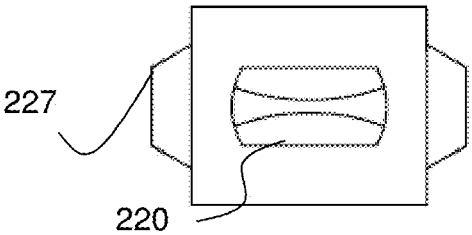
FIG. 41 is a back view of the pivoting spout of FIG. 37.
Figure 42:
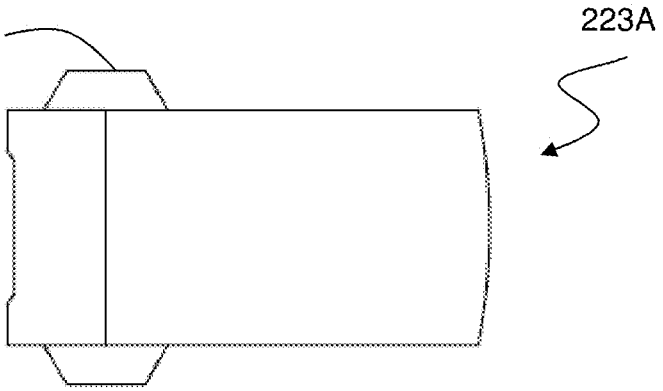
FIG. 42 is a top view of the pivoting spout of FIG. 37.
Figure 43:
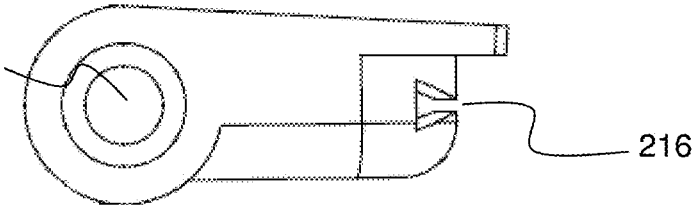
FIG. 43 is a side vide of the pivoting spout of FIG. 37.
Figure 44:
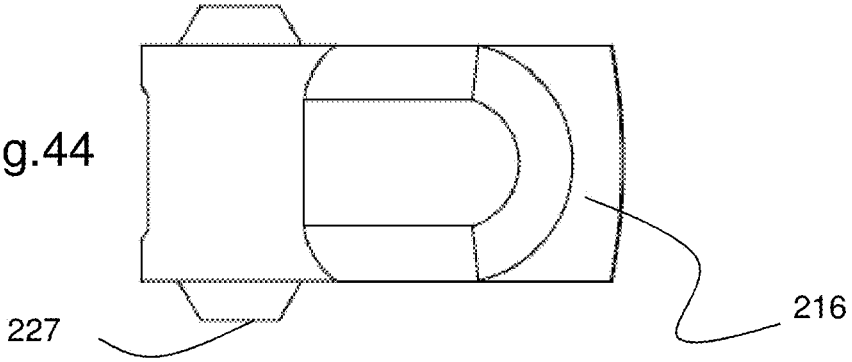
FIG. 44 is a bottom view of the pivoting spout of FIG. 37.

FIGS. 39-41 show details of the spout 223A (the spout 223B would be similar but would have the protrusions 223C as shown in FIG. 38). FIG. 39 shows a perspective view. The spout may have a pivot point 227 on either side that may snap or otherwise fit into closure body 212. FIG. 40 shows a front view of spout 223A, in this case with a bow tie shaped exit orifice 216. FIG. 41 shows a back view of spout 223A. FIG. 42 shows a top view of spout 223A. FIG. 43 shows a side view of spout 223A. FIG. 44 shows a bottom view of spout 223A.

The flow conduit 220 may extend through spout 223A from the opening shown at the back of the spout, out to the exit orifice 216 at the front of the orifice. When the spout is open, that is in a other than in a horizontal position, the entrance of the flow conduit 220 at the back of spout 223A may communicate with the container 900 so that fluid expelled from the container passes through the flow conduit and out the exit orifice. However when the pivoting spout is in a closed or horizontal position, the entrance of the flow conduit 220 at the back of spout 223A is not in communication with the container 900 and therefore the spout is closed.

The exit orifice 216 may have a lateral width of between 0.2 and 0.4 inches, or between 0.25 and 0.35 inches. The exit orifice may have a minimum height in a central region of between 0.01 and 0.04 inches, or between 0.02 and 0.03 inches. The maximum height of the exit orifice at the side regions may be between 0.05 and 0.08", or between 0.06 and 0.07 inches. The upper and or lower surface of the exit orifice may have a radius of curvature between 0.25 and 0.5 inches, or between 0.3 and 0.4 inches, or about 0.35 inches.

The spout tip portion 218 defines a shape of the exit orifice 216 which facilitates the production of the fan-type spray. The orifice 216 may have a substantially rectangular shape with a uniform width to provide a uniform thickness and width of the fan-type spray when it exits through the exit orifice 216. Also, it should be noted that to produce a continuous fan-type spray, the exit orifice 216 may also define a uniform width, especially for the rectangular shape, and the tip portion 218 may have a relatively uniform thickness of material.

The dispensing closure 210A can provide a fan-type discharge using multiple configurations of the dispensing orifice 216. Other shapes of the exit orifice 216 that may be used are, for example, a bowtie shape (FIG. 14, 37, or 40), curved rectangular shape (FIG. 15), dumbbell shape (FIG. 16), half bowtie shape (FIG. 17), keyhole shape (FIG. 18), oval shape (FIG. 19), "J" shape, "T" shape, inverted "T" shape, inverted "J" shape, and other non-circular shapes.

The bowtie shape (FIG. 14, 37, or 40) of the dispensing or exit orifice 216 provides a lighter stream of liquid from the middle of the dispensing orifice 216 and heavier stream of liquid at its ends. This may be particularly desirable for purposes of discharging a toilet bowl cleaner inside an interior of a bowl where more liquid may be desirable in an upper lip area and towards the center of the bowl. In another embodiment, the dispensing orifice may be designed in the shape of a "T", "J", inverted "J", and inverted "T". These different configurations provide a lighter stream of liquid from the middle of the dispensing orifice with a heavier stream at a single end.

In another embodiment, the dispensing orifice 16 may also have a non-uniform width along the tip portion 118 of the flow conduit 220. For example, the "fan" orifice 216 may have an increased or decreased width of the dispensing orifice 216 depending upon the viscosity of the product and desired angular flow of the liquid.

It would be appreciated by those skilled in the art that various changes and modifications can be made to the illustrated embodiments without departing from the spirit of the present invention. All such modifications and changes are intended to be within the scope of the present invention.

What is claimed is:

1. A dispensing closure for discharging a sprayable or streamable liquid from a squeeze container, comprising:

a closure body comprising an upper deck, a skirt depending downwardly from the upper deck, the skirt defining a lower interior opening configured and arranged to attach to a neck of the container; and a spout pivotally attached to the closure body and pivotally movable between a closed position and an open position, the spout comprising a flow conduit extending through the spout from an interior of the closure to an exterior of the closure, a dispensing tip portion at a distal end of the flow conduit, wherein the dispensing tip portion has a semi-spherical outer shape, an entrance orifice at a proximal end of the flow conduit and an exit orifice defined through the semi-spherical outer shape of the dispensing tip portion;

wherein the spout being pivotally movable relative to said closure body between the closed position wherein the dispensing tip portion is at least partly recessed into the closure body and the entrance orifice is not in communication with the lower interior opening, and an open position wherein said dispensing tip portion is pivoted upward relative to the closure body and the entrance orifice is in communication with the lower interior opening;

wherein the exit orifice being configured and arranged to produce a non-circular fan spray or stream in a low-pressure environment when the squeeze container is inverted and squeezed; and wherein an upper surface of the spout, adjacent to the semi-spherical outer shape of the dispensing tip portion, is planar.

2. The dispensing closure of claim 1 wherein the closure body includes a stop mechanism configured to stop movement of the spout when the spout is pivoted to the open position.

3. The dispensing closure of claim 1 wherein the closure body includes a child resistant locking mechanism.

4. The dispensing closure of claim 2 wherein the closure body includes a child resistant locking mechanism.

5. The dispensing closure of claim 1, wherein the dispensing tip portion has an interior volume, defined by the semi-spherical outer shape, to collect liquid before liquid exits through the exit orifice at less than 5 psi.

6. The dispensing closure of claim 5, wherein the exit orifice has a shape selected from a group consisting of: rectangular, bowtie, half bowtie, oval, keyhole, dumbbell, and curved rectangular.

7. The dispensing closure of claim 2, wherein the dispensing tip portion has an interior volume, defined by the semi-spherical outer shape, to collect liquid before liquid exits through the exit orifice at less than 5 psi.

8. The dispensing closure of claim 7, wherein the exit orifice has a shape selected from a group consisting of: rectangular, bowtie, half bowtie, oval, keyhole, dumbbell, and curved rectangular.

9. The dispensing closure of claim 3, wherein the dispensing tip portion has an interior volume, defined by the semi-spherical outer shape, to collect liquid before liquid exits through the exit orifice at less than 5 psi.

10. The dispensing closure of claim 9, wherein the exit orifice has a shape selected from a group consisting of: rectangular, bowtie, half bowtie, oval, keyhole, dumbbell, and curved rectangular.

11. The dispensing closure of claim 1, wherein the exit orifice has a shape selected from a group consisting of comprising: rectangular, bowtie, half bowtie, oval, keyhole, dumbbell, and curved rectangular.

12. The dispensing closure of claim 4, wherein the dispensing tip portion has an interior volume, defined by the semi-spherical outer shape, to collect liquid before liquid exits through the exit orifice at less than 5 psi.

13. The dispensing closure of claim 12, wherein the exit orifice has a shape selected from a group consisting of: rectangular, bowtie, half bowtie, oval, keyhole, dumbbell, and curved rectangular.

* * * * *